US006357197B1

(12) United States Patent
Serino et al.

(10) Patent No.: US 6,357,197 B1
(45) Date of Patent: Mar. 19, 2002

(54) POLYMER COVERED ADVANCED POLYMER/WOOD COMPOSITE STRUCTURAL MEMBER

(75) Inventors: Sherri M. Serino; Anthony L. Garofalo, both of St. Paul; Maurice N. Goeser, Maplewood, all of MN (US); Michael J. Deaner, Osceola, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 08/795,816

(22) Filed: Feb. 5, 1997

(51) Int. Cl.[7] ..... E04B 1/38; E04C 3/00; E04C 3/29

(52) U.S. Cl. ..... 52/738.1; 52/734.1; 52/736.3; 52/737.4; 52/309.16; 264/279; 156/244.12; 29/897.31; 29/897.312; 29/527.1

(58) Field of Search ..... 52/734.1, 734.2, 52/726.2, 745.19, 730.3, 736.3, 737.4, 738.1, 309.7, 309.15, 309.16; 264/279; 156/244.12, 304.3, 304.5, 304.6; 29/897.312, 897.35, 527.1, 527.2; 428/57

(56) References Cited

U.S. PATENT DOCUMENTS

| | | | | |
|---|---|---|---|---|
| 2,817,620 A | | 12/1957 | Golick et al. | |
| 2,891,876 A | | 6/1959 | Brown et al. | |
| 2,926,729 A | | 3/1960 | Zanini | |
| 3,082,490 A | * | 3/1963 | Loucks | 52/734.1 |
| 3,432,883 A | | 3/1969 | Erck | |
| 3,513,118 A | | 5/1970 | Legue et al. | |
| 3,544,669 A | | 12/1970 | Schock | |
| 3,791,750 A | | 2/1974 | Cameron | |
| 3,991,146 A | * | 11/1976 | Barrie | |
| 4,059,715 A | | 11/1977 | Pletcher | |
| 4,295,910 A | | 10/1981 | Cooley et al. | |
| 4,390,578 A | * | 6/1983 | Brooks | 52/309.15 X |
| 4,481,701 A | | 11/1984 | Hewitt | |
| 4,738,813 A | * | 4/1988 | Finkensiep | |
| 4,822,202 A | | 4/1989 | Gustafsson | |
| 4,975,477 A | | 12/1990 | Cox et al. | |
| 5,131,783 A | | 7/1992 | Astl | |
| 5,259,686 A | | 11/1993 | Hatch | |

(List continued on next page.)

FOREIGN PATENT DOCUMENTS

| | | |
|---|---|---|
| DE | 132 323 | 9/1978 |
| EP | 0 036 286 | 9/1981 |
| EP | 0 235 442 | 9/1987 |
| EP | 0 586 213 | 3/1994 |
| EP | 0 677 381 | 10/1995 |
| EP | 0 747 205 | 12/1996 |
| FR | 1.245.245 | 9/1960 |
| FR | 2 431 628 | 2/1980 |
| LU | 59178 | 7/1969 |

OTHER PUBLICATIONS

Owens, D.K. et al., "Estimation of the Surface Free Energy of Polymers", *Journal of Applied Polymer Science*, 13(8):1741–1747 (Aug. 1969).

*Primary Examiner*—Robert Canfield
(74) *Attorney, Agent, or Firm*—Merchant & Gould P.C.

(57) ABSTRACT

A composite structural member of the invention comprises a linear member having a first end and a second end attached to each end of the linear member as an end piece or end cap structure. Covering the composite member is a thermoplastic envelope preferably adherently bonded to the composite member. The end caps or end pieces are preferably thermoplastic materials typically thermoplastic composites comprising a thermoplastic resin and a fiber. Such a member is environmentally stable, resists moisture absorption, forms strong mitered joints and can be used in the assembly of fenestration products for commercial and residential real estate.

35 Claims, 6 Drawing Sheets

U.S. PATENT DOCUMENTS

| | | | |
|---|---|---|---|
| 5,338,569 | A | 8/1994 | Hatch |
| 5,352,308 | A | 10/1994 | Tomihara et al. |
| 5,378,758 | A | 1/1995 | Amici et al. |
| 5,406,768 | A | 4/1995 | Giuseppe et al. |
| 5,417,904 | A | 5/1995 | Razi et al. |
| 5,441,801 | A | 8/1995 | Deaner et al. |
| 5,486,553 | A | 1/1996 | Deaner et al. |
| 5,497,594 | A | 3/1996 | Giuseppe et al. |
| 5,539,027 | A | 7/1996 | Deaner et al. |
| 5,585,155 | A | 12/1996 | Heikkila et al. |
| 5,661,943 | A | 9/1997 | Hagel |
| 5,873,209 | A | 2/1999 | Hagel |
| 5,950,391 | A | 9/1999 | Hagel |

* cited by examiner

POLYMER COVERED ADVANCED POLYMER/WOOD COMPOSITE STRUCTURAL MEMBER

FIELD OF THE INVENTION

The invention relates to the fabrication of polymer film covered structural members used in residential and commercial architecture and structural members preferably used in the manufacture of windows and doors and to materials used for such members. More particularly, the invention relates to an improved composite structural member having superior properties, that can be used as a direct replacement for structural components made of wood or metal and can be joined to form strong structures. The structural members of the invention can comprise film covered sized covered lumber replacements and structural components with complex shapes such as rails, jambs, stiles, sills, tracks, stop sash and trim elements such as grid cove, bead, quarter round, etc.

BACKGROUND OF THE INVENTION

Conventional window and door manufacture utilize structural members made commonly from hard and soft wood members, extruded thermoplastic and extruded metal, typically aluminum, components. Residential windows and doors are often manufactured from a number of specially shaped milled wood products that are assembled with glass sheets to form typically double hung or casement windows and sliding or hinged door units. Wood windows and doors while structurally sound and well adapted for use in many residential installations, require painting and other routine maintenance and can have problems under certain circumstances caused by insect or fungal attack and by other deterioration of wood components. Wooden windows also suffer from cost problems related to the availability of suitable wood for construction. Clear wood and related wood products are becoming more scarce and costs have increased rapidly as demand increases.

Metal windows and doors have been introduced into the marketplace. Such metal windows and doors are often made from extruded aluminum parts that when combined with glass, rubber and thermoplastic curable sealant materials form utility components. Metal windows typically suffer from the drawback that they tend to be energy inefficient and tend to transfer substantial quantities of heat from a heated exterior to a cold environment.

Extruded thermoplastic materials have been used in the manufacture of window and door components. Typically, non-structural seals, edging, grill and coatings have been manufactured from filled and unfilled thermoplastic materials. Further, thermoplastic polyvinylchloride materials have been combined with wooden structural members in the manufacturing of PERMASHIELD® brand windows manufactured by Andersen Corporation for many years. The technology for forming the PERMASHIELD® windows is disclosed in Zanini, U.S. Pat. Nos. 2,926,729 and 3,432,883. In the manufacture of the PERMASHIELD® brand windows, a polyvinylchloride envelope or coating is extruded around the wooden member as it passes through an extrusion die. Such covered members are commonly used as structural components in forming the window frame or double hung or casement units. In the typical Zanini structure the envelope is not adhered to the internal member. Structural integrity is maintained by corner welding the vinyl envelopes.

Laminated films have been formed over a variety of substrates such as those disclosed in Schock, U.S. Pat. No. 3,544,669 which discloses forming a thermoplastic laminate over a wood core by passing a wood member through an extrusion die and extruding a first adhesive coating followed by a thermoplastic film coating which is adhered to the wood member. Cooley et al., U.S. Pat. No. 4,295,910 teach vinyl film/cellulosic laminates such as a film coated particle board. The film is adhesively bonded to the particle board material. Lastly, Hewitt, U.S. Pat. No. 4,481,701 teaches a plastic profile member having an exterior laminate coating or cladding.

Significant advances have been made in articles and processes combining polymer resins such as polyvinylchloride resins and wood fiber materials in the manufacture of pellets, structural members and hollow profiles for residential and industrial window and door manufacture. U.S. Pat. Nos. 5,406,768, 5,441,801, 5,486,553, 5,497,594 and 5,539,027 disclose various aspects of an improved technology involving combining polyvinylchloride and wood fiber to make composite materials for use in structural components of windows and doors. These materials achieve a substantial Young's modulus that can substantially exceed 500,000 psi, possess significant tensile strength, compressive strength, a coefficient of thermal expansion that matches a number of wood components, possess a resistance to insect attack, rot and deterioration, and is easy to work, shape and can be used as a direct substitute for wood materials.

BRIEF DISCUSSION OF THE INVENTION

Figure 1:
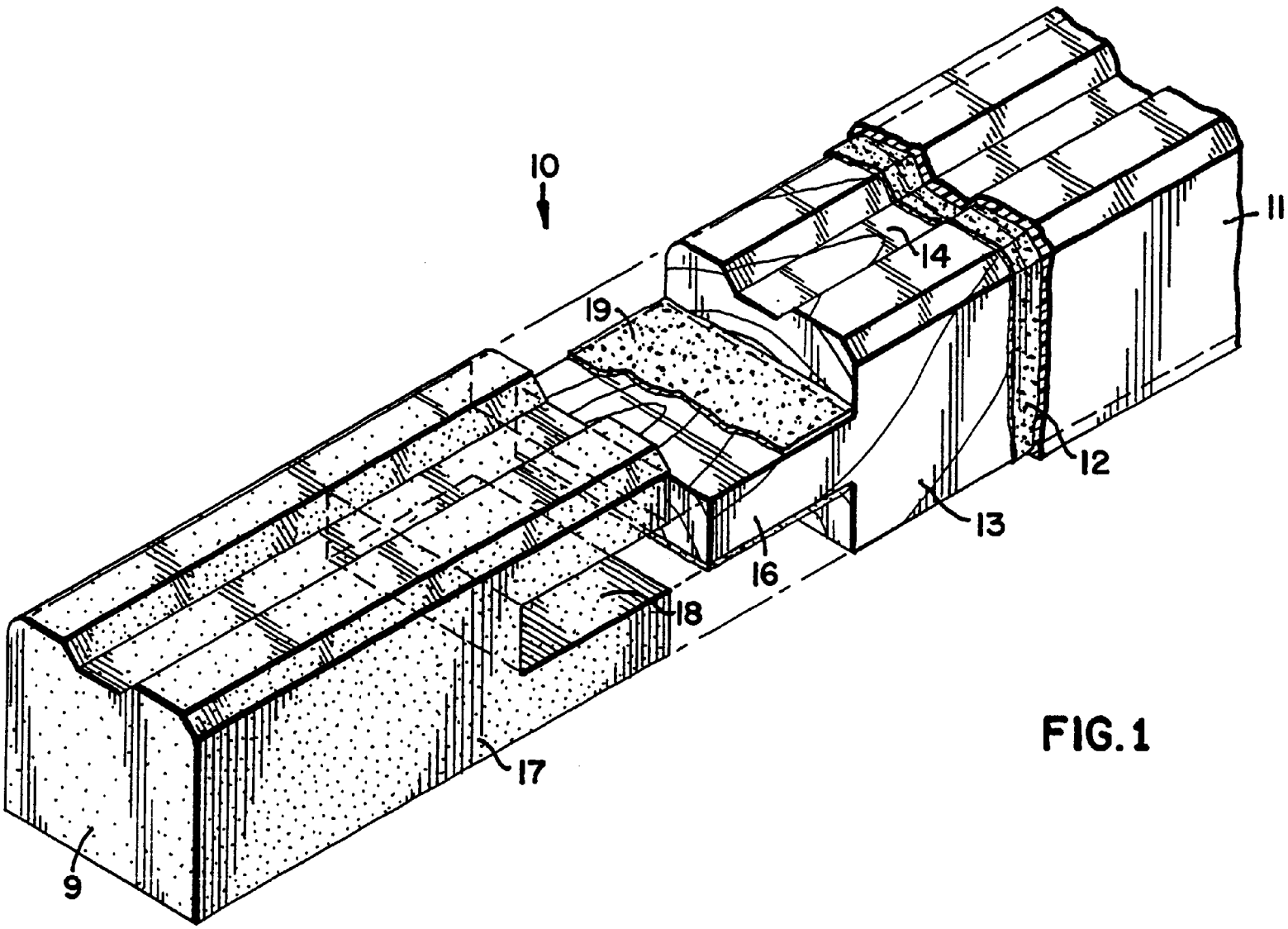
FIG. 1 is an isometric exploded drawing of the structural member of the invention comprising a linear member two end pieces (one shown) and an adhered film envelope. The Figure shows a portion of one end of the structural member comprising the linear member covered by the vinyl thermoplastic envelope adhesively bonded to the structural member. An end piece is shown positioned for joining to the structural member using an adhesive.

We have found that an improved structural member can be made in the form of a composite member made from a combination of materials contained within a thermoplastic envelope. Such a member includes a linear member having a first end and a second end. At the first end and the second end, an end piece, made of a material different than the linear member, is formed and joined onto the linear member. The end piece typically comprises a thermoplastic composition comprising a resin composition or a thermoplastic composite comprising a resin composition and a fiber reinforcement. The end pieces are typically joined to the linear member either adhesively or mechanically. The structural member comprising a linear member and its joined end pieces are covered with a thermoplastic layer or film envelope adhered to the member. The structural member of the invention can be made in a manner such that the end pieces are completely covered by the envelope. The envelope preferably covers the entire length (i.e., the lateral portion) of the structural member, including the lateral portions of the linear member and end pieces, but typically leaves the ends or terminus of each end piece uncovered (see FIG. 1). The envelope typically comprises an extruded thermoplastic film composition comprising a thermoplastic resin and is preferably adhesively joined to the entire lateral surface of both the linear member and to each end piece of the structural member. Commonly, the linear member is commonly used in window and door manufacture and comprises a milled wood piece, an extruded aluminum piece, a vinyl structural extrusion, etc.

DETAILED DISCUSSION OF THE INVENTION

The preferred process for forming the structural member of the invention involves first obtaining a linear member by preparing a composite member, milling a wooden member or extruding an aluminum piece into a desired profile shape or obtaining such a member to act as the linear member. One useful member is shown in Heikkila, U.S. Pat. No. 5,585,155. Such a member is then prepared for joining a thermoplastic end piece to each end of the wooden member. Preferably, a thermoplastic composite end piece is joined at each end of the linear member. The linear member can be prepared for joinery to the end piece by first milling the joint ends of the wooden member to a shape that conforms to a conforming or matching shape formed on or milled into the end piece. Such shapes can be any common joinery profile including finger joints, dovetail joints, tongue and groove joinery, butt joinery, etc. The end pieces are manufactured from a thermoplastic composite comprising, e.g. a thermoplastic polymer and a reinforcing (e.g.) wood fiber and can be molded with a joinery surface. The end pieces can be extruded in a substantially solid form in a profile shape that matches in a cojoined article the exterior surface linear member to provide a smooth member surface. Alternately, the surface to be joined to the linear member can be milled to form a corresponding or conforming shape to the shape of the joinery surface on the linear member. The opposite end of the end piece from the joinery surface can be any arbitrary shape. The shape can be a butt joint, can be a 90° angle mitered joint, tongue and groove joint, etc. The end piece is then joined to the linear member using mechanical joinery or adhesive technology or both. The end piece and the linear members are indexed to ensure that the resulting lateral surfaces of the final structural member align and the surface flows smoothly across the joint between materials forming an unbroken linear surface that can be easily covered with a crosslinking curing or thermosetting adhesive and the thermoplastic envelope.

The width and depth of the member is dictated by the desired profile shape of the end use, and can range from about 3 to 30 cm. The length of the composite structural member and the length of each end piece and linear member can be arbitrarily chosen depending on end use. The end pieces can range from about 5 centimeters to several meters (10 meters plus) in length. The linear member can also range from any useful length (i.e., less than 10 cm) to 10–15 meters in length. Preferably, the overall composite structural member has a length that ranges from about 10–20 centimeters to 10 to 15 meters in length. Typically the length of the end pieces is chosen to permit ease of assembly of the structural member in assembly operations that convert such composite structural members into a useful fenestration product such as a window or door unit with minimal loss in cutting or trimming operations. The end pieces must have sufficient mass, length and strength to permit handling, cutting, joinery and installation of the end pieces in manufacturing steps that incorporate the composite structural member into a fenestration unit.

Typically, the composite film covered structural members of the invention are joined into fenestration units using either mitered joints or using a joint structure that is either adhesively or mechanically attached to each end piece resulting in a mechanically stable joint. Such a joint structure can use a corner piece comprising a wooden, metal, or a thermoplastic piece that can be screwed or adhesively attached or thermally welded to each end piece to form a mechanically stable joint. In such joinery, the end pieces are commonly milled to form a conforming or mating surface for the corner piece. In such milling, the corner piece is either attached to a depression formed in the surface of the end piece to form a joint flush with the surface of the end piece. Additionally, an interior space can be milled into the end piece that will accept the corner piece. The corner piece can be affixed in place using metal fasteners or adhesive joinery techniques. Additionally, in forming such a joint, the end pieces can be mitered to mating surfaces which can be joined using thermowelding, adhesive joinery or mechanical joint forming techniques.

The composition and processes of the invention provide a method for forming a thermoplastic envelope composition over the structural member of the invention comprising a linear member and an end piece attached to each end of the linear member. The invention provides a method of forming such a thermoplastic envelope by extruding the envelope onto the linear structural member and end pieces of the structure invention. The envelope, formed using extrusion techniques, is typically intimately associated along the lateral surface of the structural member and end pieces, will tightly adhere without the formation of bubbles or other imperfections in the envelope material. Further, the envelope, adhered to the structural member, will form an integral structural part of the structural member resulting in a fully formed integrated unit well adapted for the manufacture of windows and doors. The structural member having a thermoplastic or thermoplastic composite end piece covered by the envelope material seals the internal linear member from the effects of the environment. Many linear members made from wood composite or other water sensitive materials can absorb water from the environment during storage or use. Sealing the linear member from the effects of the environment using a cooperation between the envelope material and the end pieces ensures that no water can contact a water sensitive linear member preventing water absorption and maintaining the structural and dimensional integrity of the overall structural member. The thermoplastic envelope covered structural member of the invention is obtained by passing an appropriately shaped structural member having thermoplastic end pieces or caps through an extrusion die, applying a layer of a thermosetting adhesive to portions of or to the entire exterior of the structural member. The envelope is then filled or extruded onto the thermoplastic adhesive covered structural member adhering the structural member. The envelope is adhered to the member forming the integrated article. The thermoplastic self-curing adhesive forms a strong structural bond between the layer member and the thermoplastic envelope.

Adhesives that can be used in forming the structural member of the invention are typically thermosetting adhesives. Crosslinking or thermosetting adhesives have value in structural members of the invention because they contain no solvent that requires evaporation prior to bond formation. The term "thermosetting" has been traditionally used to indicate crosslinking compositions that form bonds using a chemical reaction that crosslinks different molecules formed in the adhesive material. Crosslinking adhesives may involve the reaction of two or more chemically different intermediates. Examples of crosslinking adhesives include formaldehyde that can condense with phenol or resorcinol, formaldehyde condensed with urea or melamine. Other adhesives are based on isocyanate compounds that can react with a polyol to give a polyurethane. An epoxy adhesive involves the reaction between an epoxy group, a primary amine or a polyamide amine and others. Crosslinking may also take place among molecules of single species, for example, the formation of a polyepoxide catalyzed by a tertiary amine and others. Most adhesives which crosslink at room temperature are packaged in two containers which are mixed just before use. A preferred adhesive, a moisture curable polyurethane adhesive are typically packaged in single packages and have long shelf life when well sealed from ambient humidity. Such adhesives, when exposed to a source of moisture (in this case moisture includes moisture from the wood or from the ambient atmosphere), react and crosslink typically using a urethane system. Preferred moisture curing systems include systems containing isocyanate prepolymers made by reaction of an aromatic or aliphatic diisocyanate with a polyether polyol. Such materials react with moisture derived from the wooden member to yield polyurethane ureas with the formation of carbon dioxide gas as a by-product. Such adhesives can also contain wood preservative, anti-fungal agents, etc. Similarly, moisture curable silicones, moisture curable unsaturated polyesters, moisture curable cyanoacrylate materials and moisture curable epoxy resins can be used in the adhesives of the invention. These materials are all commonly available and can be obtained from adhesive manufacturers such as H. B. Fuller Company, National Starch and Chemical Company, Findley Incorporated, etc. Such adhesives can also be used in joining the end piece to the first layer member at the joint between the member and the end piece.

Figure 3:
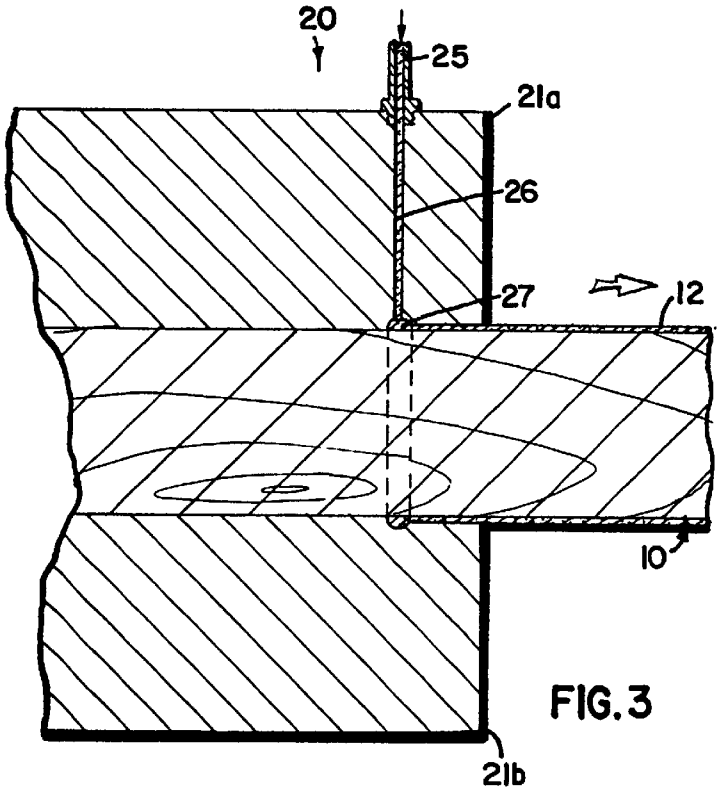
FIGS. 2 and 3 are drawings of an extrusion device having an extrusion die and guide for applying a hot melt thermosetting adhesive material on the structural member. Such an adhesive can be used to adhere the thermoplastic envelope to the structural member to fix the envelope uniformly to the structural member.
Figure 2:
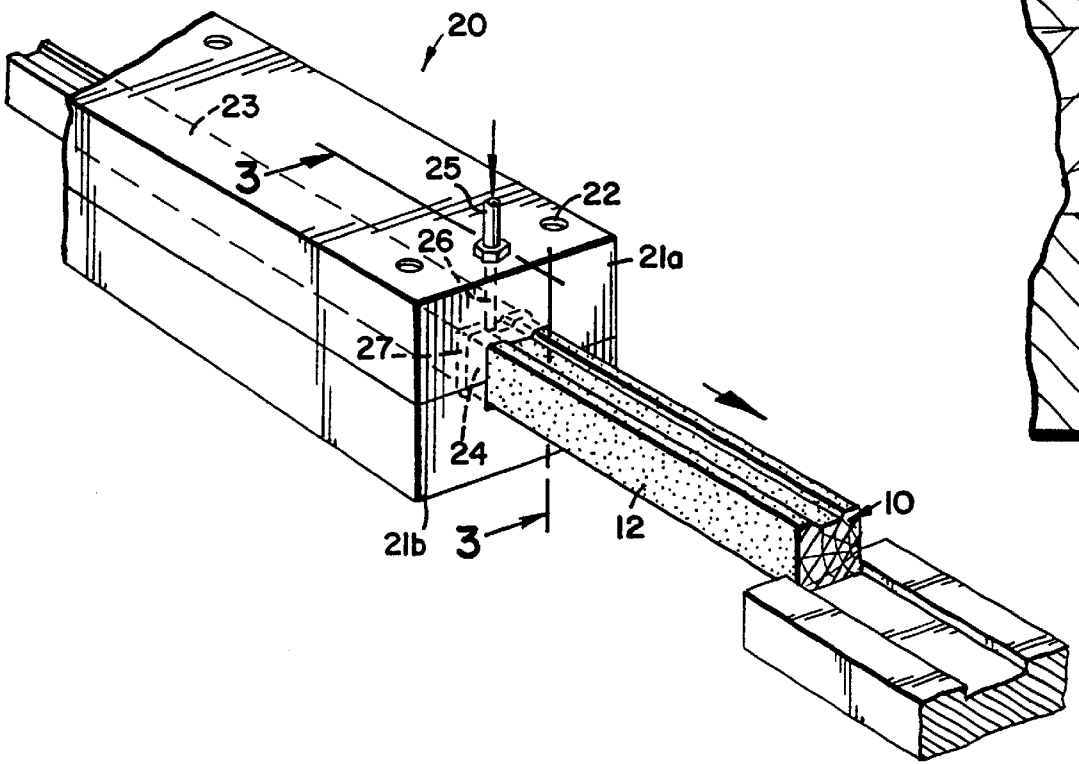

Equipment useful for extruding the adhesive layer and the thermoplastic material over the adhesive layer is commonly available in the industry (see FIGS. 2 and 3). Such equipment require extrusion dies that are sized and configured to permit the controlled flow and formation of a constant controllable dimension or thickness of thermosetting adhesive on a linear member followed by a controlled thickness and profile of the thermoplastic material. The sizing of such a die, the flow rates, temperatures of the die, the die exit locations and other parameters of the extrusion process can be established with little experimentation by the ordinary skilled artisan in adhesive and thermoplastic extrusion.

We have found that substantial variation in the width and depth of the linear member and end pieces can be tolerated through the use of the adhesive as a filler material to provide a smooth uniform surface for adhering the envelope material in the structural member composite. In manufacturing processes, the linear member can have a substantial variation in width or depth along its length. In addition, at the interface between the linear member and the end pieces, a difference in width and depth can create a surface defect. Additionally, the linear member or the end pieces can have surface defects from place to place that can be repaired by the use of a filler. Extruding a hot melt adhesive along the lateral portions of the end pieces and linear member can result in an adhesive surface having substantial uniformity. The adhesive surface providing a uniform surface can provide an adhesive base for the adherent attachment of the envelope material resulting in a smooth uniform external appearance for the envelope. The variability in lateral (width or depth) dimension of the end pieces or linear member can be as much as ±0.020 inch but is more typically about 0.010 inch or less. The use of the adhesive to improve the surface uniformity of the end piece and linear member can result in a finished component with dimensional variability of less than about ±0.005 inch.

DETAILED DESCRIPTION OF THE DRAWINGS

FIG. 1 is an exploded perspective representation of a composite member 10 having a vinyl envelope 11 adhered, with an adhesive layer 12, to a wood member or core 13 with composite end portions 17 (one shown) using a moisture curing urethane adhesive material 12. The terminus or end 9 of the end piece 17 is shown. The wooden member 13 has a milled surface with a surface indentation 14. The interior of the vinyl envelope 11 conforms to the adhesive 12 coated wooden member 13 with indentation 14. Each milled (e.g.) tongue section end (one shown) 16 of the wooden member 13 is conformed to a similarly shaped or formed grooved end 18 in the thermoplastic end portion 17. The end portion 17 having a groove 18 is adhered to the wooden member 12 at a tongue joint 16 an optional adhesive layer 19 is shown. The lateral portions of wooden member 13 and end piece 17 are covered with adhesive 12 and vinyl envelope 11. Terminus 9 is left uncovered.

FIG. 2 is an isometric view of an extruder die used to form the layer of moisture curing adhesive over the structural member that is followed by a vinyl layer (not shown) of a thermoplastic film from a conventional vinyl extruder (not shown). In FIG. 2, the extruder die 20 is shown with the structural member 10 with the adhesive coating 12. The extruder die has an upper portion 21*a* and a lower portion 21*b*. These portions are joined using a bolt connector 22. The joined portions 21*a* and 21*b* form a passage 23 through the extruder die for the structural member 10. Also formed by the portions 21*a* and 21*b* is a channel or a gauge 24 to form a consistent even layer of the hot melt moisture cure adhesive layer. In use the adhesive is melted in a conventional adhesive melter (not shown) and directed from the adhesive melter through a conventional heated line (not shown) into melt adhesive inlet 25. The hot melt adhesive passes from inlet 25 through passage 26 and gauge 24 into a metered application layer 27 surrounding the structural member 10. A controlled layer 12 of adhesive is formed on structural member 10 by careful selection of die dimensions and by careful control of the viscosity (temperature) of the adhesive, the pressure of the adhesive and the rate the structural member 10 passes through the die 20. The dimensions of the application area 27 within the extrusion head 20 is typically about 0.25 inch in width and about 0.010 inch in depth. The adhesive layer is typically about 0.005 inch in depth and covers the entire lateral surface of the structural member 10.

FIG. 3 is a cross-sectional view at 3 of the adhesive extruder die 20 in FIG. 2. In FIG. 3 the structural member 10 passes through the application die 20 formed from portions 21*a* and 21*b*. The direction of passage of the structural member 10 is shown. Melt adhesive enters the die through inlet 25 and passes through the die passage 26 to applicator portion 27. The rate of adhesive application is controlled by controlling viscosity (temperature of the adhesive), dimensions of the applicator surface and the rate the wood member passes through the die. In FIG. 3 the adhesive layer 12 is shown having a thickness of about 0.005 inches.

Figure 4A:
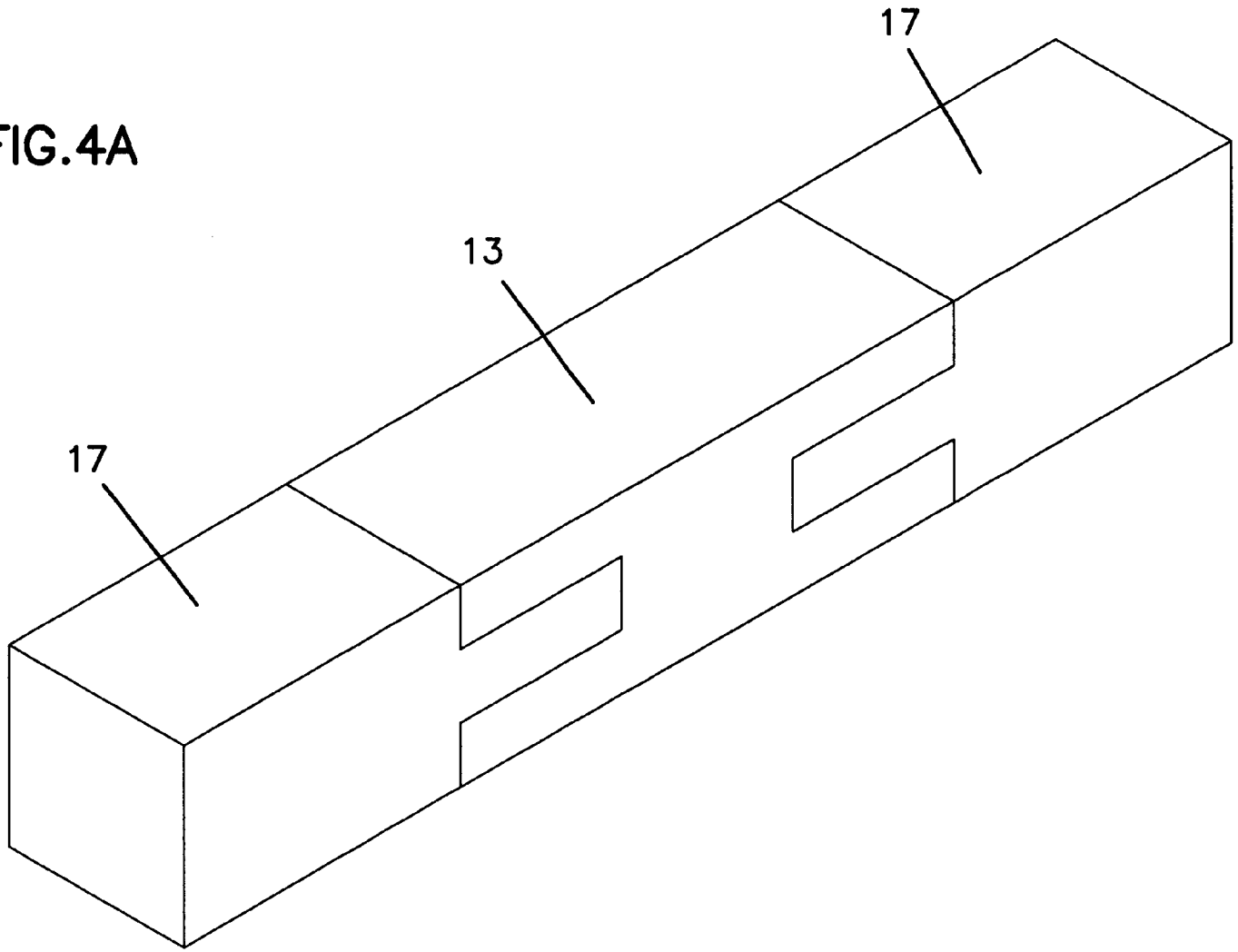
FIG. 4*a* is a figure of a composite member having a linear member and end pieces.
Figure 4B:
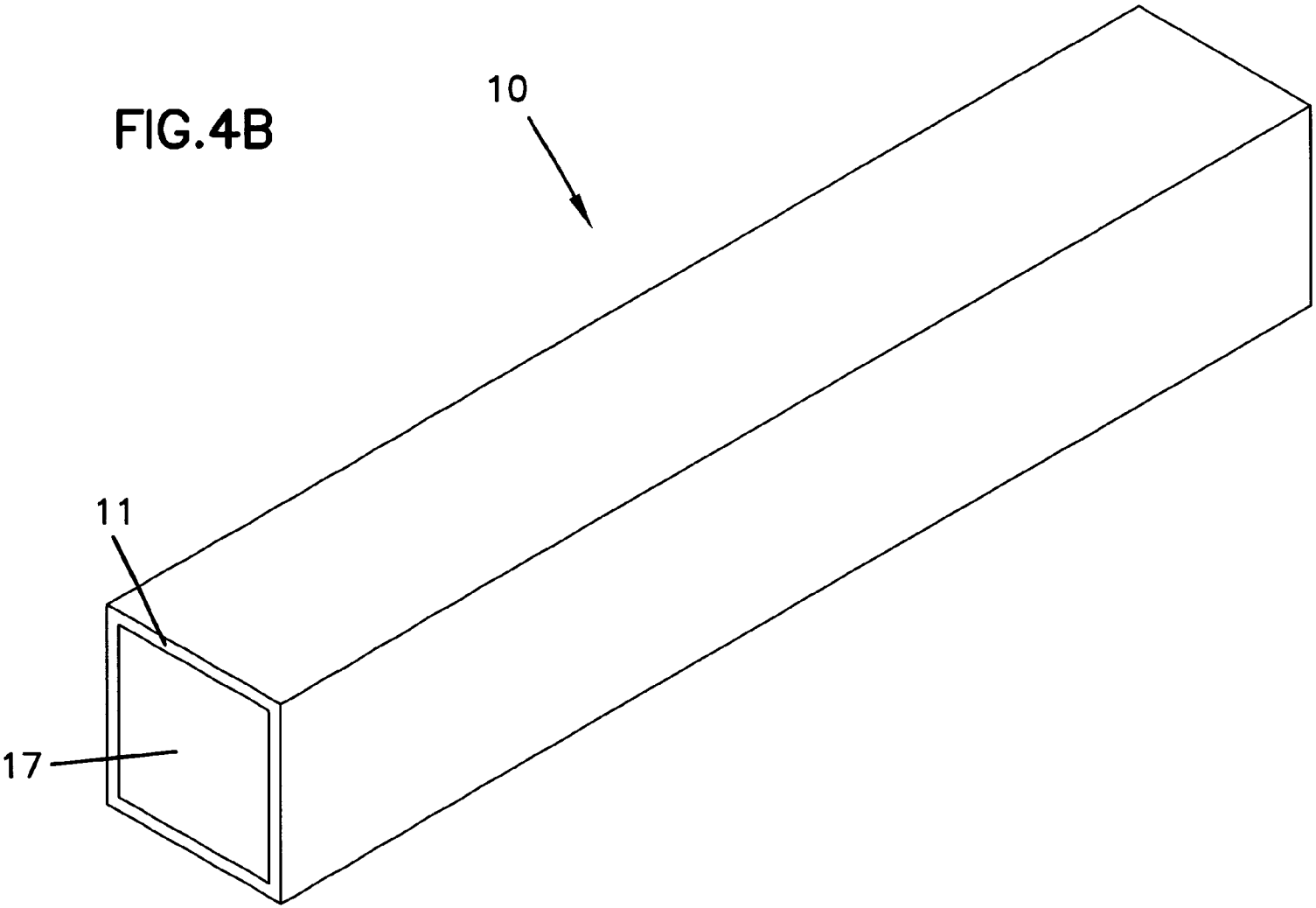
FIG. 4*b* shows a structural member formed by covering the composite member of FIG. 4*a* with an envelope.
Figure 5:
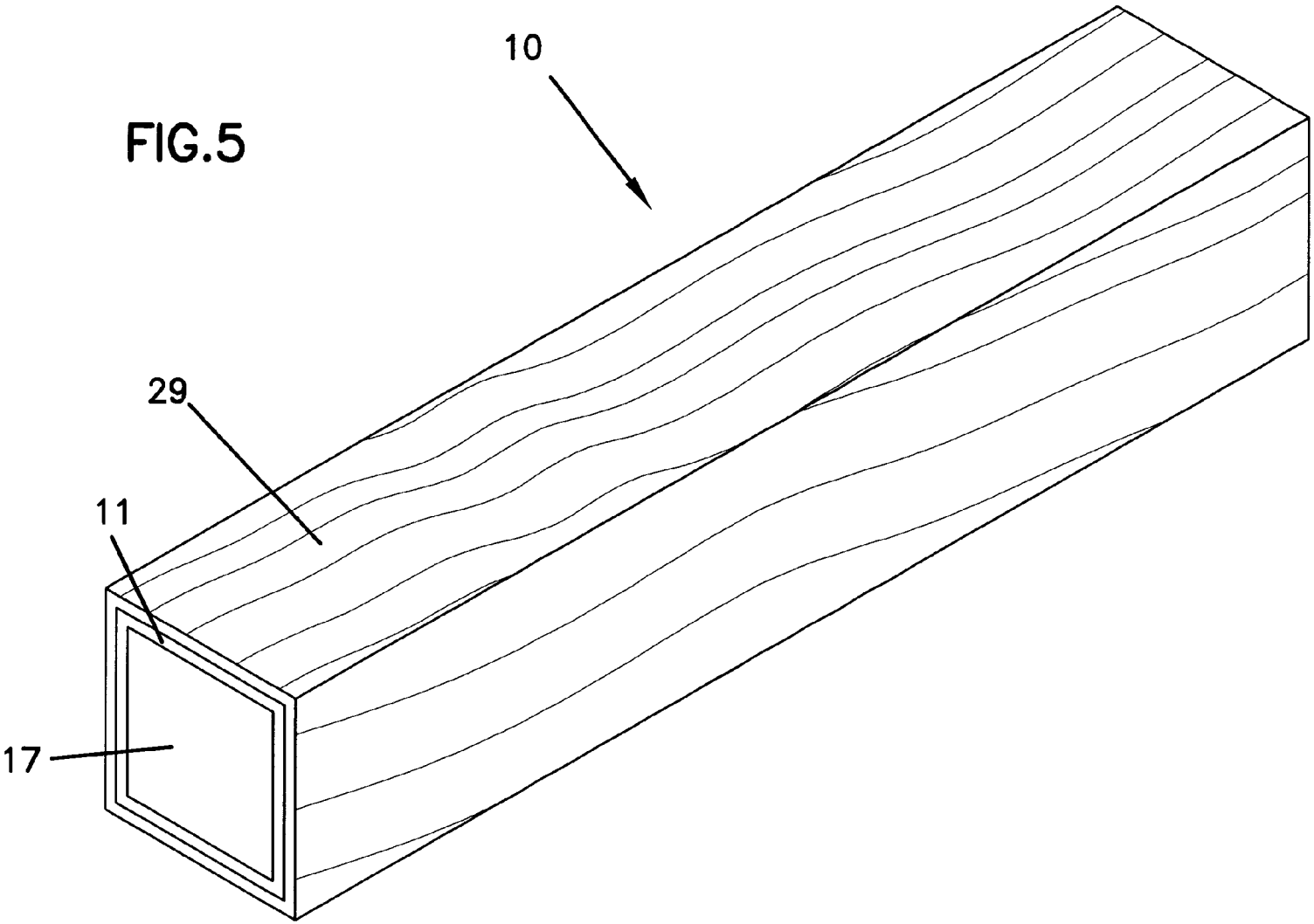
FIG. 5 additionally shows the composite member of FIG. 4*a* with both an envelope and a capstock having a wood grain exterior.
Figure 6A:
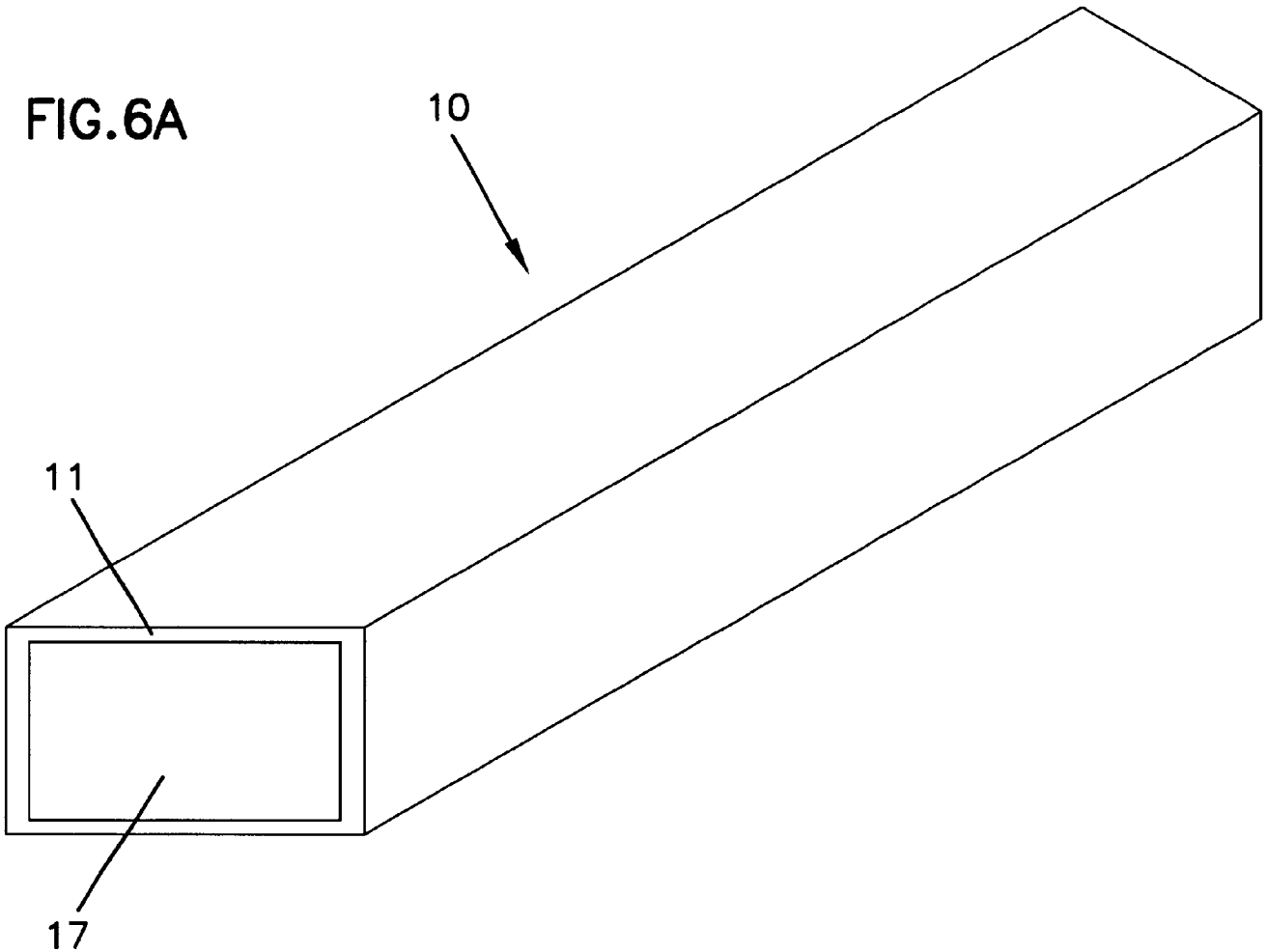
FIG. 6*a* shows a mitered cut of a structural member in the end piece region.

FIG. 4*a* shows a composite member having a linear member 13 joined to each end piece 17 with a finger joint. FIG. 4*b* shows a structural member 10 formed by covering the composite member of FIG. 4*a* with an envelope 11. FIG. 5 shows a structural member 10 formed by covering the composite member of FIG. 4*a* with both an envelope 11 and a capstock layer 29 having a wood grain exterior. FIGS. 6*a* shows a mitered cut of a structural member 10 in the end piece region.

The invention comprises a structural member comprising a linear member having an end member or piece joined to each of the first and the second end of the linear member. The linear member and each end member or piece is, in turn, covered with an envelope. The envelope is preferably adhesively joined to the structural member and the end pieces. The end pieces can be mechanically or adhesively joined to the linear member. The envelope can cover the entire lateral surface of structural member and can be adhered to the member with an adhesive layer that covers the entire surface of the member. Such a linear member can be processed and included in the manufacture of window and door structures in both residential and commercial real estate.

The Linear Member

The linear member typically comprises a member made from a structural material such as wood, metal or an engineering resin. Preferred members are made of milled or shaped wood and milled or extruded aluminum. Common woods used in the manufacture of the linear member of the invention include a variety of woods obtained from pine trees, redwood, cedar, oak, etc. The linear member can be made of extruded aluminum profile members of known composition and shape. For the purpose of this invention, the term "linear member" implies a member having a specific cross-sectional profile that has a known use in window and door manufacture. Typically, the length of the linear member is at least three times, preferably four or more times, the width of a cross-section of a linear member. Typically, such linear members are introduced into structural members of the invention using common joinery techniques, adhesive bonding or mechanical fasteners.

Each end of the linear member is adapted to be joined to an end piece preferably made of a material different than the linear member. The end pieces typically comprise a thermoplastic resin or a thermoplastic composite described below. The end pieces can be joined to the linear member mechanically or adhesively. Mechanical joinery can include the formation of a hole in each member which is used in combination with a dowel to join the linear member to the end piece. Other joinery techniques can include tongue and groove, mortise and tenon, dovetail joints, finger joints, etc. The end pieces can also be adhesively joined to the linear member using an adhesively bonded butt joinery or adhesives can be applied to the mechanical joinery techniques discussed above. Further, mechanical joinery techniques that can be used include the use of screw or nail or other such fasteners that can form a mechanically sound joint.

ENVELOPE

The linear member and its joined end caps can be covered with an envelope material. Such envelope substantially covers the lateral surfaces or exterior portions of the linear member and end caps and can optionally cover the ends of each end cap in the structural member assembly. The envelope can be preformed or can be continually formed by extrusion and can be extruded in place over the structural member as the structural member is introduced into and through an extruder device or die. The thermoplastic material used to form the envelope can be any of the thermoplastic or engineering resins disclosed below. The preferred envelope material comprises one or more layers of polyvinylchloride resin composition, a polyvinylchloride composite or a polyvinylchloride envelope having one or more additional layers comprising a capstock, a wood grain covering, a pigmented covering, or other coextruded layers.

The envelope material is extruded with a cross-sectional profile shape to match the profile of the structural member and has a thickness of about 0.001 to 0.100 inches. The envelope is typically formed in an extrusion device having an extrusion die that conforms the thermoplastic material to a particular cross-sectional profile shape matching the structural member. The die can be adapted to virtually any shape and can conform the envelope material to the shape of the profile that is typically introduced into the shaped wooden member or the extruded aluminum part.

The End Caps or End Pieces can Comprise a Thermoplastic Resin, an Engineering Resin Thermoplastic Polymer, Copolymer or Polymeric Alloy or Composites Thereof A large variety of engineering resins can be used in the envelope and the composite end piece materials of the invention. For the purpose of this application, an engineering resin is a general term covering a thermoplastic that may or may not contain a filler or reinforcing material that have mechanical, chemical and thermal properties suitable for use as structural components, machine components and chemical processing equipment components. We have found that the engineering resins useful in the invention include both condensation polymeric materials and vinyl polymeric materials. Included are both vinyl and condensation polymer resins, and alloys thereof. Vinyl polymers are typically manufactured by the polymerization of monomers having an ethylenically unsaturated olefinic group. Condensation polymer resins are typically prepared by a condensation polymerization reaction which is typically considered to be a stepwise chemical reaction in which two or more molecules combined, often but not necessarily accompanied by the separation of water or some other simple typically volatile substance. If a polymer is formed, the process is called polycondensation. Vinyl resins include acrylonitrile-butadiene-styrene (ABS), polybutylene resins, polyacetyl resins, polyacrylic resins, homopolymers or copolymers comprising vinyl chloride, vinylidene chloride, fluorocarbon resins, etc. Condensation polymers include nylon, phenoxy resins, polyarylether such as polyphenylether, polyphenylsulfide materials; polycarbonate materials, chlorinated polyether resins, polyethersulfone resins, polyphenylene oxide resins, polysulfone resins, polyimide resins, thermoplastic urethane elastomers and many other resin materials.

Not every engineering resin is useful in the composite materials disclosed. Composite materials typically comprise a polymer phase and a composite phase comprising a fiber, fill or other solid. First the engineering resin must have a surface energy such that the material is compatible with a composite component. Resins that are not compatible with the fiber, filler or the composite solid will not sufficiently wet the composite solid to intimately bond and penetrate the composite solid to obtain sufficient engineering properties. For the purpose of this invention, surface energy or surface wettability is defined in ASTMD 724–89 as revised and explained in the paper Owens et al. "Estimation of the Surface Free Energy of Polymers," *Journal of Applied Polymers Science*, Vol. 13 pp. 1741–1747 (1969). This method has become a standard method for quantifying surface energy. We have found that a useful surface energy is greater than about 40 dynes per square centimeter. Further, we have found that the engineering resin must have sufficient viscosity at processing temperatures substantially less than the decomposition temperature of wood fiber. Accordingly, the processing temperature of the thermoplastic material must be substantially less than about 450° F. (340° C.) preferably between 180 and 240° C. Further, we have found that the engineering resin used in the composite of the invention must have little or no moisture sensitivity. In other words, when processed at thermoplastic temperatures, the resin as a result of instability in the presence of moisture, does not substantially change its molecular weight or melt index. A substantial change in molecular weight or melt index is a 50% reduction in molecular weight or a doubling in melt index. Lastly, after the thermoplastic material is manufactured by combining the thermoplastic engineering resin and the wood fiber, the resulting composite has a modulus greater than about 500, 000 psi. Further, the composite material should have a two hour water absorption ASTM D-57-81 less than 2% preferably less than 1% most preferably less than 0.6%.

Condensation polymer resins that can be used in the composite materials of the invention include polyamides, polyamide-imide polymers, polyarylsulfones, polycarbonate, polybutylene terephthalate, polybutylene naphthalate, polyetherimides, polyethersulfones, polyethylene terephthalate, thermoplastic polyimides, polyphenylene ether blends, polyphenylene sulfide, polysulfones, thermoplastic polyurethanes and others. Preferred condensation engineering resins include polycarbonate materials, polyphenyleneoxide materials, and polyester materials including polyethylene terephthalate, polybutylene terephthalate, polyethylene naphthalate and polybutylene naphthalate materials.

Polycarbonate engineering resins are high performance, amorphous engineering thermoplastics having high impact strength, clarity, heat resistance and dimensional stability. Polycarbonates are generally classified as a polyester or carbonic acid with organic hydroxy compounds. The most common polycarbonates are based on phenol A as a hydroxy compound copolymerized with carbonic acid. Materials are often made by the reaction of a bisphenol A with phosgene (COCl2). Polycarbonates can be made with phthalate monomers introduced into the polymerization extruder to improve properties such as heat resistance, further trifunctional materials can also be used to increase melt strength or extrusion blow molded materials. Polycarbonates can often be used as a versatile blending material as a component with other commercial polymers in the manufacture of alloys. Polycarbonates can be combined with polyethylene terephthalate acrylonitrile-butadiene-styrene resins, styrene maleic anhydride resins and others. Preferred alloys comprise a styrene copolymer and a polycarbonate. Preferred melt for the polycarbonate materials should be indices between 0.5 and 7, preferably between 1 and 5 gms/10 min.

A variety of polyester condensation polymer materials including polyethylene terephthalate, polybutylene terephthalate, polyethylene naphthalate, polybutylene naphthalate, etc. can be useful in the engineering resin wood fiber thermoplastic composites of the invention. Polyethylene terephthalate and polybutylene terephthalate are high performance condensation polymer materials. Such polymers often made by a copolymerization between a diol (ethylene glycol, 1,4-butane diol) with dimethyl terephthalate. In the polymerization of the material, the polymerization mixture is heated to high temperature resulting in the transesterification reaction releasing methanol and resulting in the formation of the engineering plastic. Similarly, polyethylene naphthalate and polybutylene naphthalate materials can be made by copolymerizing as above using as an acid source, a naphthalene dicarboxylic acid. The naphthalate thermoplastics have a higher Tg and higher stability at high temperature compared to the terephthalate materials. However, all these polyester materials are useful in the composite structural materials of the invention. Such materials have a preferred molecular weight characterized by melt flow properties. Useful polyester materials have a viscosity at 265° C. of about 500–2000 cP, preferably about 800–1300 cP.

Polyphenylene oxide materials are engineering thermoplastics that are useful at temperature ranges as high as 330° C. Polyphenylene oxide has excellent mechanical properties, dimensional stability, and dielectric characteristics. Commonly, phenylene oxides are manufactured and sold as polymer alloys or blends when combined with other polymers or fiber. Polyphenylene oxide typically comprises a homopolymer of 2,6-dimethyl-1-phenol. The polymer commonly known as poly(oxy-(2,6-dimethyl-1,4-phenylene)). Polyphenylene is often used as an alloy or blend with a polyamide, typically nylon 6—6, alloys with polystyrene or high impact styrene and others. A preferred melt index (ASTM 1238) for the polyphenylene oxide material useful in the invention typically ranges from about 1 to 20, preferably about 5 to 10 gm/10 min. The melt viscosity is about 1000 at 265° C.

Vinyl Polymers

A large variety of vinyl polymeric materials can be used in the composite materials can be used in the composite materials of the invention.

However, a preferred class of thermoplastic include styrenic copolymers. The term styrenic copolymer indicates that styrene is copolymerized with a second vinyl monomer resulting in a vinyl polymer. Such materials contain at least a 5 mol-% styrene and the balance being 1 or more other vinyl monomers. An important class of these materials are styrene acrylonitrile (SAN) polymers. SAN polymers are random amorphous linear copolymers produced by copolymerizing styrene acrylonitrile and optionally other monomers. Emulsion, suspension and continuous mass polymerization techniques have been used. SAN copolymers possess transparency, excellent thermal properties, good chemical resistance and hardness. These polymers are also characterized by their rigidity, dimensional stability and load bearing capability. Olefin modified SAN's (OSA polymer materials) and acrylic styrene acrylonitriles (ASA polymer materials) are known. These materials are somewhat softer than unmodified SAN's and are ductile, opaque, two phased terpolymers that have surprisingly improved weatherability.

ASA resins are random amorphous terpolymers produced either by mass copolymerization or by graft copolymerization. In mass copolymerization, an acrylic monomer styrene and acrylonitrile are combined to form a heteric terpolymer. In an alternative preparation technique, styrene acrylonitrile oligomers and monomers can be grafted to an acrylic elastomer backbone. Such materials are characterized as outdoor weatherable and UV resistant products that provide excellent accommodation of color stability property retention and property stability with exterior exposure. These materials can also be blended or alloyed with a variety of other polymers including polyvinyl chloride, polycarbonate, polymethyl methacrylate and others. An important class of styrene copolymers includes the acrylonitrile-butadiene-styrene monomers. These resins are very versatile family of engineering thermoplastics produced by copolymerizing the three monomers. Each monomer provides an important property to the final terpolymer material. The final material has excellent heat resistance, chemical resistance and surface hardness combined with processability, rigidity and strength. The polymers are also tough and impact resistant. The styrene copolymer family of resins have a melt index that ranges from about 0.5 to 25, preferably about 0.5 to 20.

An important class of engineering resins that can be used in the composites of the invention include acrylic resins. Acrylics comprise a broad array of polymers and copolymers in which the major monomeric constituents are an ester acrylate or methacrylate. These resins are often provided in the form of hard, clear sheet or pellets. Acrylic monomers polymerized by free radical processes initiated by typically peroxides, azo compounds or radiant energy. Commercial polymer formulations are often provided in which a variety of additives are modifiers used during the polymerization provide a specific set of properties for certain applications. Pellets made for resin grade applications are typically made either in bulk (continuous solution polymerization), followed by extrusion and pelleting or continuously by polymerization in an extruder in which unconverted monomer is removed under reduced pressure and recovered for recycling. Acrylic plastics are commonly made by using methyl acrylate, methylmethacrylate, higher alkyl acrylates and other copolymerizable vinyl monomers. Preferred acrylic resin materials useful in the composites of the invention has a melt index of about 0.5 to 50, preferably about 1 to 30 gm/10 min.

Vinyl polymer resins include a acrylonitrile; alpha-olefins such as ethylene, propylene, etc.; chlorinated monomers such as vinyl chloride, vinylidene dichloride, acrylate monomers such as acrylic acid, methylacrylate, methylmethacrylate, acrylamide, hydroxyethyl acrylate, and others; styrenic monomers such as styrene, alphamethyl styrene, vinyl toluene, etc.; vinyl acetate; and other commonly available ethylenically unsaturated monomer compositions.

Polymer blends or polymer alloys can be useful in manufacturing the pellet or linear extrudate of the invention. Such alloys typically comprise two miscible polymers blended to form a uniform composition. Scientific and commercial progress in the area of polymer blends has lead to the realization that important physical property improvements can be made not by developing new polymer material but by forming miscible polymer blends or alloys. A polymer alloy at equilibrium comprises a mixture of two amorphous polymers existing as a single phase of intimately mixed segments of the two macro molecular components. Miscible amorphous polymers form glasses upon sufficient cooling and a homogeneous or miscible polymer blend exhibits a single, composition dependent glass transition temperature (Tg). Immiscible or non-alloyed blend of polymers typically displays two or more glass transition temperatures associated with immiscible polymer phases. In the simplest cases, the properties of polymer alloys reflect a composition weighted average of properties possessed by the components. In general, however, the property dependence on composition varies in a complex way with a particular property, the nature of the components (glassy, rubbery or semi-crystalline), the thermodynamic state of the blend, and its mechanical state whether molecules and phases are oriented.

The primary requirement for the substantially thermoplastic engineering resin material is that it retain sufficient thermoplastic properties to permit melt blending with a composite fiber, permit formation of linear extrudate pellets, and to permit the composition material or pellet to be extruded or injection molded in a thermoplastic process forming the rigid structural member. Engineering resin and resin alloys are available from a number of manufacturers including B.F. Goodrich, G.E., Dow, and duPont.

PREFERRED ENGINEERING RESIN THERMOPLASTIC PARAMETERS

| | USEFUL | PREFERRED |
|---|---|---|
| PROCESS TEMPERATURE | T < 250° C. | 150°–240° C. |
| MOISTURE SENSITIVITY | Less than 4× increase in MI | Less than 2× increase in MI |
| SURFACE ENERGY FOR CELLULOSIC COMPOSITES | E > 40 dynes/cm$^2$ | E > 45 dynes/cm$^2$ |
| FLEX MODULUS (RESIN) | >200,000 | >300,000 |

FIBER REINFORCEMENT

Composites are typically formed by combining typically a thermoplastic continuous phase with a second material that provides superior or additional properties to the thermoplastic. Such properties include increases strength, stiffness, fatigue life, fracture toughness, environmental resistance and reduced weight. The most common composite form is fiber reinforced plastic materials wherein the fiber in each layer are either aligned or randomly oriented. A variety of reinforcing fibers can be used including glass, boron, carbon, aramid, metal, cellulosic, polyester, nylon, etc. Composite fiber can be used in the form of random oriented small fiber, relatively large chopped aligned fiber, fabric or unidirectional fiber lengths. A preferred fiber for use in this invention is wood fiber. In the manufacture of the end cut materials of the invention, the polymer and fiber are typically combined to form a composite. The composite is then shaped by heat and pressure into the desired profile shape used in forming the end pieces. Such profile matches the profile of the linear member such that the end pieces form a continuous profile shape from the linear member through the uncapped piece.

One alternative manufacturing process can involve combining thermoplastic and fiber into a pellet material. The pellet material can then be placed into a machine for forming the pellet into a useful profile shape. Such an intermediate pellet shape provides substantial work to the product and can substantially increase the interaction between the polymer and the fiber resulting in an improved composite material.

Wood fiber is a preferred composite fiber. In terms of abundance and suitability wood fiber can be derived from either soft woods or evergreens or from hard woods commonly known as broad leaf deciduous trees. Soft woods are generally preferred for fiber manufacture because the resulting fibers are longer, contain high percentages of lignin and lower percentages of hemicellulose than hard woods. While soft wood is the primary source of fiber for the invention, additional fiber make-up can be derived from a number of secondary or fiber reclaim sources including bamboo, rice, sugar cane, and recycled fibers from newspapers, boxes, computer printouts, etc.

However, the primary source for wood fiber of this invention comprises the wood fiber by-product of sawing or milling soft woods commonly known as sawdust or milling tailings. Such wood fiber has a regular reproducible shape and aspect ratio. The fibers based on a random selection of about 100 fibers are commonly at least 0.1 mm in length, up to 1 mm in thickness and commonly have an aspect ratio of at least 1.5. Preferably, the fibers are 0.1 to 5 mm in length with an aspect ratio between 2 and 15, preferably 2.5 to 10. The preferred fiber for use in this invention are fibers derived from processes common in the manufacture of windows and doors. Wooden members are commonly ripped or sawed to size in a cross grain direction to form appropriate lengths and widths of wood materials. The by-product of such sawing operations is a substantial quantity of sawdust. In shaping a regular shaped piece of wood into a useful milled shape, wood is commonly passed through machines which selectively removes wood from the piece leaving the useful shape. Such milling operations produces substantial quantities of sawdust or mill tailing by-products. Lastly, when shaped materials are cut to size and mitered joints, butt joints, overlapping joints, mortise and tenon joints are manufactured from pre-shaped wooden members, substantial waste trim is produced. Such large trim pieces are commonly cut and machined to convert the larger objects into wood fiber having dimensions approximating sawdust or mill tailing dimensions. The wood fiber sources of the invention can be blended regardless of particle size and used to make the composite. The fiber stream can be pre-sized to a preferred range or can be sized after blending. Further, the fiber can be pre-pelletized before use in composite manufacture.

Such sawdust material can contain substantial proportions of waste stream by-products. Such by-products include waste polyvinyl chloride or other polymer materials that have been used as coating, cladding or envelope on wooden members; recycled structural members made from thermoplastic materials; polymeric materials from coatings; adhesive components in the form of hot melt adhesives, solvent based adhesives, powdered adhesives, etc.; paints including water based paints, alkyd paints, epoxy paints, etc.; preservatives, anti-fungal agents, anti-bacterial agents, insecticides, etc., and other waste streams common in the manufacture of wooden doors and windows. The total waste stream content of the wood fiber materials is commonly less than 25 wt-% of the total wood fiber input into the composite product. Of the total waste recycle, approximately 10 wt-% of that can comprise a thermoplastic. Commonly, the intentional recycle ranges from about 1 to about 25 wt-%, preferably about 2 to about 20 wt-%, most commonly from about 3 to about 15 wt-% of contaminants based on the sawdust.

In the manufacture of the resin/fiber composite composition and pellet of the invention, the manufacture and procedure requires two important steps. A first blending step and a second pelletizing step. The resulting pellets are then thermoplastically converted into the end-piece.

During the blending step, the engineering resin and fiber are intimately mixed by high shear mixing components with recycled material to form a polymer fiber composite wherein the polymer mixture comprises a continuous organic phase and the composite solid with the recycled materials forms a discontinuous phase suspended or dispersed throughout the polymer phase. The manufacture of the dispersed fiber phase within a continuous polymer phase requires substantial mechanical input. Such input can be achieved using a variety of mixing means including preferably extruder mechanisms wherein the materials are mixed under conditions of high shear until the appropriate degree of wetting and intimate contact is achieved. After the materials are fully mixed, the moisture content can be controlled at a moisture removal station. The heated composite is exposed to atmospheric pressure or reduced pressure at elevated temperature for a sufficient period of time to remove moisture resulting in a final moisture content of about 8 wt-% or less. Lastly, the polymer fiber is aligned and extruded into a useful form.

The preferred equipment for mixing and extruding the composition and wood pellet of the invention is an industrial extruder device. Such extruders can be obtained from a variety of manufacturers including Cincinnati Millicron, etc.

The materials feed to the extruder can comprise from about 30 to 70 wt-% of composite solid preferably fiber including recycled impurity along with the balance an engineering resin composition. Preferably, about 35 to 65 wt-% wood fiber or sawdust is combined with 65 to 35 wt-% of resin. The resin feed is commonly in a small particulate size which can take the form of flake, pellet, powder, etc. Any polymer resin form can be used such that the polymer can be dry mixed with the sawdust to result in a substantially uniform pre-mix. The fiber input can be derived from a number of sources. Preferred wood fiber can be derived from plant locations including the sawdust resulting from rip or cross grain sawing, milling of wood products or the intentional commuting or fiber manufacture from waste wood scrap. Such materials can be used directly from the operations resulting in the wood fiber by-product or the by-products can be blended to form a blended product. Further, any wood fiber material alone, or in combination with other wood fiber materials, can be blended with waste stream by-product from the manufacturer of wood windows as discussed above. The wood fiber or sawdust can be combined with other fibers and recycled in commonly available particulate handling equipment.

Resin and fiber are then dry blended in appropriate proportions prior to introduction into blending equipment. Such blending steps can occur in separate powder handling equipment or the polymer fiber streams can be simultaneously introduced into the mixing station at appropriate feed ratios to ensure appropriate product composition.

In a preferred mode, the fiber component is placed in a hopper, controlled by weight or by volume, to proportion fiber into the mixer. The resin is introduced into a similar resin input system. The amount of resin and fiber are adjusted to ensure that the composite material contains appropriate proportions on a weight or volume basis. The fibers are introduced into an extrusion device preferably a twin screw extrusion device. The extrusion device has a mixing section, a transport section and melt section. Each section has a desired heat profile resulting in a useful product. The materials are introduced into the extruder at a rate of about 600 to about 1000 pounds of material per hour and are initially heated to a temperature that can maintain an efficient melt flow of resin. A multistage device is used that profiles processing temperature to efficiently combine resin and fiber. The final stage of extrusion comprises a head section. The head sections can contain a circular distribution (6–8" diameter) of 10 to 500 or more, preferably 20 to 250 orifices having a cross-sectional shape leading to the production of a regular cylindrical pellet. As the material is extruded from the head it is cut with a double-ended knife blade at a rotational speed of about 100 to 400 rpm resulting in the desired pellet length.

| THERMOPLASTIC/FIBER COMPOSITE PARAMETERS | | |
|---|---|---|
| | USEFUL | PREFERRED |
| FLEX MODULUS | >500,000 | >700,000 |
| TWO HOUR WATER ABSORPTION | <1.0% | |
| COEFFICIENT OF THERMAL EXPANSION | $<2.5 \times 10^{-5}$ in/in-° F. | $<1.5 \times 10^{-6}$ in/in-° F. |
| HEAT DISTORTION TEMPERATURE | T > 100° C. | T > 105° C. |
| IMPACT ENERGY | >4 in-lb | >6 in-lb |

The following examples were performed to further illustrate the composite invention that is explained in detail above. The following information illustrates the typical production conditions and compositions and the tensile modulus of a structural member made from the pellet. The following examples and data contain a best mode.

Sample Preparation

A laboratory scale twin screw Brabender extruder is used to prepare samples of engineering resin-wood fiber composites. The following resins were used:

| Brand Name | Generic Name | MFR. gm/10 min.* | Viscosity, Poise |
|---|---|---|---|
| Norryl PPO N190X | Poly phenylene oxide | 5–10 | 1050 @ 265° C. |
| Valox PBT 357 | Poly butylene terephthalate | | 800–1300 @ 265° C. |
| Centrex ASA Monsanto 833 | Acrylonitrile styrene acrylate terpolymer | 0.8–5 | |
| ABS + PC Cycloloy 2950 | Acrylonitrile-Butadiene-Styrene terpolymer/ polycarbonate blend | 1–5 | |
| Lustran ABS Monsanto 633 | Acrylonitrile butadiene styrene terpolymer | 0.9–5 | |
| Tyrel SAN Dow 1000 | Styrene-Acrylonitrile | 3.5–20 (lb/10 min. | |
| | Polyacetal | 0.002–0.03 | |
| CAB Eastman | Cellulose acetate butyrate | Flow Temp ~ 180° C., Melt Flow not reported | |
| Geon PVC | Polyvinyl chloride | 0.8–25 | |

*Melt index/melt flow rate as measured by ASTM 1238

The polymer-sawdust mixture is fed to the extruder with a volumetric feeder. The feed rate is adjusted to give a smooth flow of material. The extruder is run at the following conditions:

| PARAMETER | SETTING |
|---|---|
| Barrel Zone 1 Temperature | 150° C. |
| Barrel Zone 2 Temperature | 165° C. |
| Barrel Zone 2 Temperature | 180° C. |
| Adapter Temperature | 185° C. |
| Die Temperature | 180° C. |
| Screw Speed | 10–15 |
| Feeder setting | 15–20 |
| Air pressure for cooling | 20 Psi |

The temperatures, feed rates and the screw speeds are adjusted to accommodate the varying flow characteristics of different polymers. After extrusion, about 4 feet length of strips were saved for physical property testing.

The foregoing specification and tables of information provide a basis for understanding the compositions and process steps that are used in the manufacture of the clad structural member of the invention. The following examples and data show the manufacture of product components, provide a best mode and test data showing certain advantages of the materials.

COMPARATIVE EXAMPLE 1

A vinyl covered wood core member covered with a moisture cure urethane adhesive to adhere a vinyl envelope to the core member was manufactured for the purpose of determining thermal performance and adhesion (peel strength) of the envelope to the wood member. In order to produce a test unit, pine treated with an antimicrobial anti-insecticidal, antifungal coating was milled to a casing profile. The pine casing was coextruded with an adhesive, in an extrusion device such as that shown in FIGS. 2 and 3, and a conforming vinyl envelope. The vinyl envelope was formed on the adhesive. The envelope composition included about 100 parts of polyvinylchloride resin (inherent viscosity=0.92), 12 parts titanium dioxide, 3 parts calcium carbonate, 7.5 parts of an impact modifier, 1.5 parts calcium stearate, 2 parts amide wax, 1.5 parts tin mercaptide heat stabilizer and 0.41 part of pigment. The adhesives used are set forth in the text next below.

EXAMPLE 1

An auxiliary casing part structural member with a wood core and two PVC/wood fiber end pieces attached to the wooden core member was also manufactured with a hot melt adhesive bonding a vinyl envelope to the structural member. The PVC/wood fiber end piece is a composite material that is 60% polyvinylchloride (100 parts PVC (inherent viscosity=0.92), 2.5 parts amide wax, 1.5 parts calcium stearate, 1.0 parts tin mercaptide) and 40% wood fiber. The wood fiber conforms to a −30/+80 U.S. mesh. The composite end caps are joined to the wood member using tongue and groove joinery (see FIG. 1). The end capped wood member is then covered with adhesive (0.005 in. adhesive) and envelope (thickness 0.037 to 0.047 inch) as described above.

PEEL TEST

This test compares the envelope adhesion of the liquid applied adhesive to a hot melt type urethane adhesive that will be used for the new structural composite process.

Product(s) Tested:

Adhesive Peel Testing Parts:

A structural member is made by applying a solid hot melt moisture cure thermosetting adhesive to the wood core within an extrusion die (see FIGS. 2 and 3) substantially the same as Comparative Example 1. The adhesive that is currently being investigated is a solid at room temperature but is liquefied at elevated temperatures and pressure. As the adhesive is heated it is pumped through an adhesive applicator die onto the wood core. The vinyl is then extruded onto the wood core and the part is cooled to room temperature. As the part cools to room temperature the adhesive solidifies and forms a bond between the wood core and the vinyl cover. During this process the adhesive is exposed to atmospheric moisture and to moisture from the wood and the adhesive curing process is initiated by reaction with water.

Auxiliary casing profile using the following adhesives to bond the vinyl to the wood core during process of the invention, approximately 5 mils of adhesive was applied at ambient to the wood core.

1) 3M EC5298 moisture curing liquid urethane adhesive.

2) National Starch 34-9026 hot melt moisture curing urethane adhesive (solid hot melt adhesive).

Test Data:

| Adhesive | Sample Description | Adhesive Peel Test Data: Average Load lb. f./in. | Failure Mode |
|---|---|---|---|
| 3M EC5298 | Aux. Casing Production | 0.306 | Adhesive failure to vinyl |
| | | 0.683 | Adhesive failure to vinyl |
| | | 1.141 | Adhesive failure to vinyl |
| | | 0.978 | Adhesive failure to vinyl |
| | | 0.707 | Adhesive failure to vinyl |
| | | 0.678 | Adhesive failure to vinyl |
| | | 0.683 | Adhesive failure to vinyl |
| | | 0.447 | Adhesive failure to vinyl |
| | | 0.932 | Adhesive failure to vinyl |
| | | 0.622 | Adhesive failure to vinyl |
| | | 1.305 | Adhesive failure to vinyl |
| | Average | 0.771 | |
| | Std. Dev. | 0.294 | |
| National Starch 34-9015 | Aux. Casing Experimental | 10.253 | Wood fiber tear |
| | | 7.292 | Wood fiber tear |
| | | 5.998 | Wood fiber tear |
| | | 4.589 | Wood fiber tear |
| | | 6.869 | Wood fiber tear |
| | | 8.217 | Wood fiber tear |
| | | 8.849 | Wood fiber tear |
| | | 9.209 | Wood fiber tear |
| | | 9.670 | Wood fiber tear |
| | | 6.804 | Wood fiber tear |
| | | 8.983 | Wood fiber tear |
| | | 19.221 | Wood fiber tear |
| | | 10.340 | Wood fiber tear |
| | | 7.188 | Wood fiber tear |
| | | 15.774 | Wood fiber tear |
| | | 9.621 | Wood fiber tear |
| | | 10.387 | Wood fiber tear |
| | | 4.231 | Wood fiber tear |
| | | 7.093 | Wood fiber tear |
| | | 7.313 | Wood fiber tear |
| | | 14.421 | Wood fiber tear |
| | | 9.279 | Wood fiber tear |
| | | 19.898 | Wood fiber tear |
| | | 5.625 | Wood fiber tear |
| | | 11.487 | Wood fiber tear |
| | | 11.480 | Wood fiber tear |
| | Average | 9.619 | |
| | Std. Dev. | 3.962 | |

Results Summary and Discussion:

Peel values for the liquid adhesive samples are considerably lower than the values that were obtained for the solid adhesive and application. When samples were prepared with the liquid urethane and tested, several of the vinyl strips broke free from the wood core while the samples were place into the test jig. Due to these premature failures fewer data points were collected for this sample set. After examination of the samples and the bond line it was determined that the adhesive did not make intimate contact with the wood core during the curing process. This may have been the cause of the poor adhesion and peel performance for this sample set. Adhesive failure to the vinyl was recorded for all of the samples that were prepared with the liquid urethane adhesive.

Peel values for the solid urethane adhesive were acceptable. Several of the samples were not tested due to vinyl breakage at the bond line before the part was placed in the Instron test machine. All of the samples exhibited wood fiber tearing during testing.

During the current testing extrusion process the parts that were assembled using the liquid urethane adhesive behaved differently than the parts with the hot applied adhesive. When the vinyl came in contact with the liquid adhesive, the vinyl and wood core could move freely. When the vinyl came in contact with the hot applied adhesive, the vinyl was firmly bonded to the wood core. After the part was pulled off of the extrusion line, it was very difficult to remove the vinyl from the wood core when the hot applied adhesive was used.

Test Method(s) Description:

Scope

This method establishes a procedure for testing vinyl to wood adhesive bonding.

Summary of Test Standard

Purpose of Test

The purpose of this test is to evaluate the peel strength of adhesive bonds between vinyl and wood under specified environmental conditions. Data generated from this test will show environmental conditions, peel strength, mode failure, and sample assembly/conditions.

Sample Preparation

Materials

Samples were cut from a production profile (see FIG. 1) to approximately 1"×18" size to determine the performance of the production process and adhesive systems. Standard vinyl blend was used to make the vinyl substrate. Finger-jointed wood core that had been treated using a standard treating solution was used for the wood core profile (see FIG. 1). The adhesive is the material being evaluated in this test.

Adhesives tested—3M EC 5298 liquid urethane adhesive.

National Starch 34-9026 hot melt urethane adhesive.

Equipment

Instron test machine

Wire wound rod of desired size

Sample Assembly

The wood substrates should be treated and dried by the current production process. The samples should be held no longer than 30 days after treating before being used. A 5 mil film of adhesive is applied to the wood core surface using an adhesive die. The wood core with the adhesive is then introduced into the extrusion process and the outer vinyl envelope is applied. After the parts have been cooled to room temperature and the adhesive has cured completely, the adhesive test sample is cut from these extrusion parts.

Sample Conditioning

The samples are then allowed to cure at room temperature condition (70° F.±5° F.) for a minimum of one week or per manufacturer's recommendation.

Test Conditions

Ambient—samples are tested after curing but without any further conditions.

Test Procedure

Select the 100 lb. load cell and crosshead speed of 5"/minute.

Mount sample into Universal Testing Machine.

Peel the overlapping vinyl away from the wood about 2".

Feed vinyl between the rollers of peel fixture and secure vertically into the clamp at the base of the Instron.

Peel strength values are averaged after the first eight inches of peel, the last two inches are not peeled.

Thermal Cycle Test

Parts A Auxiliary casing parts similar to Comparative Example 1 with a vinyl envelope with normally liquid moisture curing urethane adhesive. The vinyl envelope had a thickness of about 0.031 inch and was manufactured at a line speed of about 17 ft. per min.

Parts B Auxiliary casing parts with a PVC/wood fiber end cap (with hot melt adhesive) substantially the same as Example 1. The composite PVC/wood fiber end cap and the conforming wood member had a tongue and groove joint with the approximate dimensions of ⅜×1−¼"×1−5⁄16". The adhesive add-on was approximately 5 mil on the exterior of the structural member. The material was manufactured at a line speed of about 5.2 ft. per min.

Parts C Auxiliary casing parts substantially similar to Example 1 were produced without adhesive applied between the vinyl and the wood core. The vinyl envelope thickness was 0.031 inch and the vinyl envelope was manufactured at a line speed of 8.3 ft. per min.

Parts D Auxiliary casing parts substantially similar to Comparative Example 1 were produced with the hot melt moisture cure urethane adhesive (no end caps). The adhesive was applied at a thickness of about 5 mils. The thickness of the vinyl envelope was about 0.031 inch and the casing was produced at a line speed of either 4.0, 6.2 or 8.3 ft. per min.

Thermal cycle testing-surface deformation measurements were recorded from these samples to determine the amount of vinyl distortion that occurred on the exterior surface of the parts after being exposed to 30 complete thermal cycles.

This procedure is applicable for extruded PVC, CPVC, capped material, and PVC bonded to wood. Both a water bath and a forced air oven method are given. The purpose of this test standard is to establish a guideline for the determination of the amount of heat shrinkage in extruded vinyls. Data generated from this test will be in the form of percent heat shrinkage.

Sample Preparation

Materials used include a 10 inch scribe, a set of calipers, a permanent marking pen and a set of twelve inch calipers, capable of measuring to an accuracy of 0.002 inch.

Equipment needed:

Water bath capable of maintaining a water temperature of 85° C. +30° C.

Forced air oven, thermostatically controlled and capable of maintaining temperature at 85° C. +30° C.

Sample Assembly

Water Bath:

Cut twelve inch long test pieces out of sample profiles.

Forced Air Oven:

Cut ten inch long test pieces out of sample profiles.

Sample Conditioning

Condition all test pieces for a sufficient amount of time to allow them to return to room temperature before beginning the test.

Water Bath Method:

Mark the sample with the ten inch scribe. Totally immerse the sample in a 85° C. water bath for 30 minutes. Remove the sample and let it cool to room temperature. Remark the part with the ten inch scribe. Calculate percent heat shrinkage with conventional arithmetic methods.

Forced Air Oven Method:

Using a permanent marking pen, place a mark on both ends of the test piece, approximately in the middle of the profile and perpendicular to the extrusion direction. Using the marks as a guide for the calipers, measure the overall length of each test piece at room temperature. Set the oven temperature to 85° C. Place the test pieces horizontally in the oven. Do not put more than four test pieces in the oven at one time. Begin timing the test when the oven reaches 85° C. Remove the test piece(s) from the oven after one hour ±five minutes at 85° C. Allow the test pieces to air cool to room temperature and measure the overall length of each test piece as done in 4.2.2.

To determine results for forced air oven method:

For both sight surfaces of each test piece, calculate the heat shrinkage using the following equation:

$$R=(\Delta L/L_0)*100 \text{ where: } \Delta L=L_0-L_1;$$

$L_0$ is the distance in inches between the marks before heating, and $L_1$ is the distance in inches between the marks after heating.

TABLE 1a

Vinyl Shrinkage Data
Vinyl Covered Wood With Liquid Adhesive

| Sample Description | % Shrinkage Side 1 | Side 2 | Side 3 | Side 4 | Line Speed (ft./min.) |
|---|---|---|---|---|---|
| Standard Production 1 | 0.140 | 0.000 | 0.000 | 0.140 | 17.0 |
| Standard Production 2 | 0.000 | 0.000 | 0.000 | 0.000 | 17.0 |
| Standard Production 3 | 0.000 | 0.000 | 0.290 | 0.000 | 17.0 |
| Standard Production 4 | 0.130 | 0.260 | 0.000 | 0.000 | 17.0 |
| Standard Production 5 | 0.150 | 0.150 | 0.000 | 0.150 | 17.0 |
| Standard Production 6 | 0.000 | 0.000 | 0.000 | 0.000 | 17.0 |
| Standard Production 7 | 0.000 | 0.000 | 0.000 | 0.000 | 17.0 |
| Standard Production 8 | 0.000 | 0.000 | 0.000 | 0.000 | 17.0 |
| Standard Production 9 | 0.000 | 0.000 | 0.000 | 0.000 | 17.0 |
| Standard Production 10 | 0.000 | 0.000 | 0.000 | 0.000 | 17.0 |
| Avg. | 0.042 | 0.041 | 0.019 | 0.029 | |
| Std. Dev. | 0.068 | 0.090 | 0.092 | 0.061 | |

TABLE 1b

Vinyl Covered Wood With Solid Hot Melt Urethane Adhesive

| Sample Description | % Shrinkage Side 1 | Side 2 | Side 3 | Side 4 | Line Speed (ft./min.) |
|---|---|---|---|---|---|
| National Starch 2 | 0.000 | 0.000 | 0.000 | 0.000 | 4.0 |
| National Starch 3 | 0.000 | 0.000 | 0.000 | 0.000 | 4.0 |
| National Starch 4 | 0.000 | 0.000 | 0.000 | 0.000 | 4.0 |
| National Starch 5 | 0.000 | 0.000 | 0.000 | 0.000 | 4.0 |
| National Starch 6 | 0.000 | 0.000 | 0.000 | 0.000 | 4.0 |
| National Starch 7 | 0.000 | 0.000 | 0.000 | 0.000 | 4.0 |
| National Starch 8 | 0.000 | 0.000 | 0.000 | 0.000 | 4.0 |
| National Starch 9 | 0.000 | 0.000 | 0.000 | 0.000 | 4.0 |
| National Starch 10 | 0.000 | 0.000 | 0.000 | 0.000 | 4.0 |
| National Starch 11 | 0.000 | 0.000 | 0.000 | 0.000 | 6.2 |

TABLE 1b-continued

Vinyl Covered Wood With Solid Hot Melt Urethane Adhesive

| Sample Description | % Shrinkage Side 1 | Side 2 | Side 3 | Side 4 | Line Speed (ft./min.) |
|---|---|---|---|---|---|
| National Starch 12 | 0.000 | 0.000 | 0.000 | 0.000 | 6.2 |
| National Starch 13 | 0.000 | 0.000 | 0.000 | 0.000 | 6.2 |
| National Starch 14 | 0.000 | 0.000 | 0.000 | 0.000 | 6.2 |
| National Starch 15 | 0.000 | 0.000 | 0.000 | 0.000 | 6.2 |
| National Starch 16 | 0.000 | 0.000 | 0.000 | 0.000 | 6.2 |
| National Starch 17 | 0.000 | 0.000 | 0.000 | 0.000 | 6.2 |
| National Starch 18 | 0.000 | 0.000 | 0.000 | 0.000 | 6.2 |
| National Starch 19 | 0.000 | 0.000 | 0.000 | 0.000 | 6.2 |
| National Starch 20 | 0.000 | 0.000 | 0.000 | 0.000 | 6.2 |
| National Starch 21 | | | | | |
| National Starch 22 | 0.000 | 0.000 | 0.000 | 0.000 | 8.3 |
| National Starch 23 | 0.000 | 0.000 | 0.000 | 0.000 | 8.3 |
| National Starch 24 | 0.000 | 0.000 | 0.000 | 0.000 | 8.3 |
| National Starch 25 | 0.000 | 0.000 | 0.000 | 0.000 | 8.3 |
| National Starch 26 | | | | | |
| National Starch 27 | | | | | |
| National Starch 28 | 0.000 | 0.000 | 0.000 | 0.000 | 8.3 |
| National Starch 29 | | | | | |
| National Starch 30 | 0.000 | 0.000 | 0.000 | 0.000 | 8.3 |
| Avg. | 0.000 | 0.000 | 0.000 | 0.000 | |
| Std. Dev. | 0.000 | 0.000 | 0.000 | 0.000 | |

TABLE 1c

Vinyl Covered Wood Core With No Adhesive

| Sample Description | % Shrinkage | | | | Line Speed (ft./min.) |
|---|---|---|---|---|---|
| No adhesive 1 | 2.185 | 2.255 | 2.185 | 2.155 | 8.3 |
| No adhesive 2 | 2.115 | 2.095 | 2.120 | 2.260 | 8.3 |
| No adhesive 3 | 2.355 | 2.255 | 2.330 | 2.285 | 8.3 |
| No adhesive 4 | 2.110 | 2.135 | 2.110 | 2.035 | 8.3 |
| No adhesive 5 | 2.510 | 2.430 | 2.150 | 2.420 | 8.3 |
| No adhesive 6 | 2.170 | 2.500 | 2.170 | 2.170 | 8.3 |
| No adhesive 7 | 2.410 | 2.410 | 2.460 | 2.420 | 8.3 |
| No adhesive 8 | 2.070 | 2.290 | 2.100 | 2.250 | 8.3 |
| No adhesive 9 | 2.250 | 2.500 | 2.730 | 2.380 | 8.3 |
| No adhesive 10 | 2.330 | 2.330 | 2.330 | 2.330 | 8.3 |
| Avg. | 2.191 | 2.185 | 2.186 | 2.184 | |
| Std. Dev. | 0.114 | 0.082 | 0.101 | 0.114 | |

The wood core parts using liquid adhesive experienced an average overall shrinkage of about 0.035%. Wood core parts made with solid hot melt moisture cure urethane adhesive experienced essentially no vinyl shrinkage. Composite parts made using no adhesive, experienced about 2.18% shrinkage.

Corner Weld Strength

In this experiment, the weld strength of a structure made by welding the end piece materials was tested and compared to a welded vinyl covered wood member. The corner strength of joints made by welding a typical wood core profile substantially like that shown in Comparative Example 1 covered by a PVC envelope, except without an end piece, was compared to a structure using a foamed polyvinyl chloride core and a similar structure using a foamed PVC/wood fiber core substantially similar to that shown in Example 1. The foamed polyvinylchloride material was obtained from Geon Corporation (Geon 87019) having a specific gravity of about 0.7. The foamed PVC/wood fiber composite comprised 60% polyvinylchloride and 40% of wood fiber foamed using a 0.5% AZRV Cellogen blowing agent using a Rohm and Haas K415 acrylic modifier. Prior to foaming, the composite had a specific gravity of 1.38 to 1.4. The foamed composite had a final specific gravity of about 1.0.

The parts used in this experiment were extruded using typical conditions shown in Table 2 for extruder operating conditions. The vinyl envelope was adhered to the various core materials. The adhesive was applied to the surface of the cores before each core entered the extrusion die for formation of the vinyl envelope. The adhesive applicator is similar in design to that shown in FIGS. 2 and 3. The adhesive die is designed to have adhesive pumped to all four surfaces of the core. The edge of the adhesive die before the parts enter the vinyl extrusion die is offset from the wood core by about 0.005 inch. This will allow at least a film of 0.005 inch of adhesive to be applied to the wood core. The core materials PVC wood fiber composite and foamed composite samples were milled to the appropriate shape (see the core in FIG. 1) using milling heads used in production of the wood parts. An Urban single point welder was used to weld the corner samples. The weld temperature was set at 280° C. with a three millimeter loss in dimensions due to the liquidization and contact weld joining of the thermoplastic material. The thermoplastic material was permitted 18 seconds for melting and 36 seconds for forming the welded joint.

TABLE 2

Extruder Operating Conditions

| Time | Motor Amps | Barrel Temperature 1 | 2 | 3 | 4 | Zone Die Temperature (zone) ° C. 1 | 2 | 3 | Feed rate lb/hr PVC | Line speed ft/m in | Sample Set |
|---|---|---|---|---|---|---|---|---|---|---|---|
| 9:05 | 18.6 | 195 | 190 | 185 | 180 | 182 | 188 | 186 | 33.7 | 5.5 | Initial |
| 11:10 | 19.5 | 196 | 197 | 191 | 186 | 186 | 190 | 194 | 31.8 | 5.2 | Wood core |
| 11:32 | 20 | 195 | 195 | 189 | 185 | 185 | 193 | 193 | 31.8 | 5.2 | Foamed parts |
| 12:30 | 16.3 | 195 | 195 | 190 | 185 | 185 | 195 | 195 | 31.8 | 5.2 | End caps |

TABLE 3

| Auxiliary Casing Profile - Wood Core | | | | | |
|---|---|---|---|---|---|
| Specimen | Maximum Load (lb.) | Maximum Displacement at Max. Load (in.) | (in.) | (in.) | (Cleave Strength (lb, in.) |
| Aux. 1-1 | 23.05 | 0.412 | 9.0 | 13.0 | 138.36 |
| Aux. 1-2 | 29.30 | 0.449 | 9.0 | 13.0 | 175.26 |
| Aux. 1-3 | 28.92 | 0.433 | 9.0 | 13.0 | 173.25 |
| Aux. 1-4 | 22.82 | 0.394 | 9.0 | 13.0 | 137.21 |
| Aux. 1-5 | 24.08 | 0.395 | 9.0 | 13.0 | 144.77 |
| Aux. 1-6 | 29.79 | 0.480 | 9.0 | 13.0 | 177.68 |
| Aux. 1-7 | 29.91 | 0.303 | 9.0 | 13.0 | 181.34 |
| Aux. 1-8 | 33.06 | 0.442 | 9.0 | 13.0 | 197.89 |
| Aux. 1-9 | 22.12 | 0.416 | 9.0 | 13.0 | 132.73 |
| Aux. 1-10 | 26.64 | 0.326 | 9.0 | 13.0 | 161.18 |
| Aux. 1-11 | 20.88 | 0.520 | 9.0 | 13.0 | 124.06 |
| Aux. 1-12 | 26.08 | 0.402 | 9.0 | 13.0 | 156.69 |
| Aux. 1-13 | 36.21 | 0.331 | 9.0 | 13.0 | 218.98 |
| Aux. 1-14 | 26.89 | 0.410 | 9.0 | 13.0 | 161.44 |
| Aux. 1-15 | 28.79 | 0.527 | 9.0 | 13.0 | 170.94 |
| Aux. 1-16 | 25.10 | 0.427 | 9.0 | 13.0 | 150.45 |
| Aux. 1-17 | 27.93 | 0.491 | 9.0 | 13.0 | 166.41 |
| Aux. 1-18 | 34.61 | 0.400 | 9.0 | 13.0 | 207.98 |
| Average | 27.57 | 0.42 | 9.0 | 13.00 | 165.37 |
| Std. Dev. | 4.27 | 0.06 | 0.00 | 0.00 | 25.89 |
| Cov | 15.5% | 14.6% | 0.0% | 0.0% | 15.7% |

TABLE 4

| Auxiliary Casing Profile - Foamed PVC/Wood Fiber Composite Core | | | | | |
|---|---|---|---|---|---|
| Specimen | Maximum Load (lb.) | Maximum Displacement at Max. Load (in.) | (in.) | (in.) | (Cleave Strength (lb, in.) |
| Aux. 2-1 | 123.80 | 0.567 | 9.0 | 13.0 | 732.24 |
| Aux. 2-2 | 112.50 | 0.523 | 9.0 | 13.0 | 668.24 |
| Aux. 2-3 | 119.30 | 0.544 | 9.0 | 13.0 | 707.20 |
| Aux. 2-4 | 129.80 | 0.589 | 9.0 | 13.0 | 766.09 |
| Aux. 2-5 | 121.30 | 0.566 | 9.0 | 13.0 | 717.53 |
| Aux. 2-6 | 116.60 | 0.534 | 9.0 | 13.0 | 691.86 |
| Aux. 2-7 | 113.50 | 0.511 | 9.0 | 13.0 | 674.95 |
| Aux. 2-8 | 134.90 | 0.624 | 9.0 | 13.0 | 793.47 |
| Aux. 2-9 | 122.90 | 0.529 | 9.0 | 13.0 | 729.59 |
| Aux. 2-10 | 123.40 | 0.577 | 9.0 | 13.0 | 729.17 |
| Aux. 2-11 | 123.50 | 0.550 | 9.0 | 13.0 | 731.67 |
| Aux. 2-12 | 100.50 | 0.635 | 9.0 | 13.0 | 590.49 |
| Aux. 2-13 | 112.70 | 0.525 | 9.0 | 13.0 | 669.30 |
| Aux. 2-14 | 124.00 | 0.574 | 9.0 | 13.0 | 732.93 |
| Aux. 2-15 | 105.30 | 0.468 | 9.0 | 13.0 | 628.75 |
| Average | 118.93 | 0.55 | 9.00 | 13.00 | 704.23 |
| Std. Dev. | 8.97 | 0.04 | 0.00 | 0.00 | 51.94 |
| Cov | 7.5% | 7.8% | 0.0% | 0.0% | 7.4% |

TABLE 5

| Auxiliary Casing Profile - Foamed PVC Core | | | | | |
|---|---|---|---|---|---|
| Specimen | Maximum Load (lb.) | Maximum Displacement at Max. Load (in.) | (in.) | (in.) | (Cleave Strength (lb, in.) |
| Aux. 3-1 | 87.63 | 0.618 | 9.0 | 13.0 | 515.73 |
| Aux. 3-2 | 120.10 | 0.910 | 9.0 | 13.0 | 686.02 |
| Aux. 3-3 | 111.80 | 0.946 | 9.0 | 13.0 | 636.15 |
| Aux. 3-4 | 94.82 | 0.642 | 9.0 | 13.0 | 556.73 |

TABLE 5-continued

| Auxiliary Casing Profile - Foamed PVC Core | | | | | |
|---|---|---|---|---|---|
| Specimen | Maximum Load (lb.) | Maximum Displacement at Max. Load (in.) | (in.) | (in.) | (Cleave Strength (lb, in.) |
| Aux. 3-5 | 112.60 | 0.872 | 9.0 | 13.0 | 645.78 |
| Aux. 3-6 | 93.71 | 0.650 | 9.0 | 13.0 | 549.78 |
| Aux. 3-7 | 87.42 | 0.603 | 9.0 | 13.0 | 515.26 |
| Aux. 3-8 | 108.00 | 0.857 | 9.0 | 13.0 | 620.37 |
| Aux. 3-9 | 105.50 | 0.801 | 9.0 | 13.0 | 609.56 |
| Aux. 3-10 | 115.80 | 0.940 | 9.0 | 13.0 | 659.34 |
| Aux. 3-11 | 84.40 | 0.592 | 9.0 | 13.0 | 497.99 |
| Aux. 3-12 | 126.10 | 0.974 | 9.0 | 13.0 | 715.35 |
| Aux. 3-13 | 87.08 | 0.600 | 9.0 | 13.0 | 513.40 |
| Aux. 3-14 | 91.19 | 0.641 | 9.0 | 13.0 | 535.47 |
| Aux. 3-15 | 92.20 | 0.624 | 9.0 | 13.0 | 546.43 |
| Aux. 3-16 | 91.45 | 0.638 | 9.0 | 13.0 | 537.16 |
| Average | 100.66 | 0.74 | 9.00 | 13.00 | 583.78 |
| Std. Dev. | 13.44 | 0.15 | 0.00 | 0.00 | 69.04 |
| Cov | 13.4% | 19.8% | 0.0% | 0.0% | 11.8% |

Results

Average corner weld strength of the foamed PVC/wood fiber samples was about 704.23 lb.-inches (standard deviation=51.94). Average corner weld strength of the foamed PVC samples was 583.16 lb.-inches (standard deviation 69.04). Average corner weld strength of the conventional PVC/wood core samples was 165.37 lb.-inches.

Vinyl Shrinking Test

Certain vinyl coated wooden and composite products were exposed to thermal cycle testing to determine the amount of shrinkage of the vinyl covering. An auxiliary casing comprising a pine core treated with an antimicrobial insecticidal fungicidal water-borne coating was covered with adhesive with a thickness of about 0.005 inch having a subsequent vinyl envelope (0.031 inch) formed over the adhesive similar to Comparative Example 1. Both liquid and hot melt moisture cure adhesive were used to manufacture the wood core parts. A vinyl covered wood product without adhesive was also prepared substantially the same as that shown in Comparative Example 1.

Thermal Cycle Test Results

Vinyl deformation was recorded on the control samples.

Vinyl Shrinkage Test Results

1) Auxiliary casing parts with liquid urethane adhesive-production material—7/32" shrinkage recorded.
2) Auxiliary casing parts with hot melt adhesive and a PVC/wood fiber end cap - no shrinkage recorded.
3) Auxiliary casing part without adhesive—¾" vinyl shrinkage recorded.
4) Auxiliary casing parts with hot melt adhesive—no shrinkage recorded.

Water Uptake Testing

After a thermal cycle testing was completed, the resulting parts were tested for water uptake. In addition to the wood core vinyl clad material with no adhesive, the wood core vinyl clad with liquid adhesive. A structural member substantially the same as Example 1 was used. In conducting such test, a container was constructed to hold the parts during the water soak test. The samples were weighed and the weights recorded prior to immersion. The parts were immersed in water in the container for one hour at ambient conditions. The samples were removed from the container. Surface moisture was removed and the structures were reweighed. The final results were then recorded. The test results are recorded in Tables 6a, 6b and 6c. In Table 6a, a wood core with a vinyl cover applied without adhesive showed a substantial weight gain averaging about 34.64 grams. In Table 6b a wood core structure with an adhesively adhered vinyl covering (using a liquid urethane) experienced an average weight gain of about 10.10 grams. In Table 6c, a composite structural member with end caps was tested. The composite end caps protected the wood core and reduced water absorption substantially resulting in an average water uptake of about 0.04 grams.

TABLE 6a

| Sample | Weight Gain (gms) | Adhesive |
|---|---|---|
| Wood with vinyl cover -1 | 36.59 | no adhesive |
| Wood with vinyl cover -2 | 39.94 | no adhesive |
| Wood with Vinyl cover -3 | 34.92 | no adhesive |
| Wood with vinyl cover -4 | 32.76 | no adhesive |
| Wood with vinyl cover -5 | 28.97 | no adhesive |
| Avg. | 34.64 | |
| Std. Dev. | 4.11 | |

TABLE 6b

| Sample | Weight Gain (gms) | Adhesive |
|---|---|---|
| Current Production -1 | 7.80 | Liquid Urethane |
| Current Production -2 | 11.70 | Liquid Urethane |
| Current Production -3 | 11.10 | Liquid Urethane |
| Current Production -4 | 11.30 | Liquid Urethane |
| Current Produation -5 | 8.60 | Liquid Urethane |
| Avg. | 10.10 | |
| Std. Dev. | 1.77 | |

TABLE 6c

| Sample | Weight Gain (gms) | Adhesive |
|---|---|---|
| Fibrex end cap -1 | 0.06 | Moisture cure urethane |
| Fibrex end cap -2 | 0.06 | Moisture cure urethane |
| Fibrex end cap -3 | 0.04 | Moisture cure urethane |
| Fibrex end cap -4 | 0.05 | Moisture cure urethane |
| Avg. | 0.05 | |
| Std. Dev. | 0.01 | |
| Wood core with PVC/wood fiber end cap -1 | 0.10 | Moisture cure urethane |
| Wood core with PVC/wood fiber end cap -2 | 0.10 | Moisture cure urethane |
| Wood core with PVC/wood fiber end cap -3 | 0.00 | Moisture cure urethane |
| Wood core with PVC/wood fiber end cap -4 | 0.00 | Moisture cure urethane |
| Wood core with PVC/wood fiber end cap -5 | 0.00 | Moisture cure urethane |
| Wood core with PVC/wood fiber end cap -6 | 0.00 | Moisture cure urethane |
| Wood core with PVC/wood fiber end cap -7 | 0.00 | Moisture cure urethane |
| Wood core with PVC/wood fiber end cap -8 | 0.00 | Moisture cure urethane |
| Wood core with PVC/wood fiber end cap -9 | 0.10 | Moisture cure urethane |
| Wood core with PVC/wood fiber end cap -10 | 0.10 | Moisture cure urethane |
| Avg. | 0.04 | |
| Std. Dev. | 0.05 | |

The above examples and test data demonstrate that the structural member of the invention comprising a core material and a vinyl envelope coated end capped PVC material, vinyl envelope coated PVC/wood fiber composite end cap material or similar foamed materials can be used to form a satisfactory joint corner welded assembly that can be used in fenestration materials. Further, the data demonstrate that the composite materials covered with a vinyl envelope have sufficient water resistance and dimensional stability (resistance to shrinkage) such that the materials can be a stable, non-warping, unchanging portion that can form a useful fenestration assembly.

The specification, tables, examples, data and drawings set forth above provide a basis for understanding the disclosed invention. However, since many embodiments of the invention may be made without departing from the spirit of the invention, the invention relies in the claims hereinafter appended.

We claim:

1. A structural member comprising:

(a) a linear member with a first shaped end and a second shaped end;

(b) an end piece with a conforming shaped end to the linear member, each end piece shaped end joined to each of the first shaped end and the second shaped end of the linear member, each end piece having a length greater than about 5 cm; each end piece comprising a thermoplastic composition comprising a resin; and (c) an envelope, covering and uniformly adhesively bonded to the linear member and end pieces, the envelope comprising an extruded thermoplastic composition comprising a resin.

2. The structural member of claim 1 wherein the linear member comprises a composite having a thermoplastic core and a fiber reinforced thermoset resin exterior layer.

3. The structural member of claim 1 wherein the linear member comprises a composite having a thermoplastic/fiber composite core and a fiberglass reinforced thermoset resin exterior layer.

4. The member of claim 3 wherein each end piece comprises a thermoplastic composite comprising a blend of a thermoplastic resin and a fiber.

5. The member of claim 4 wherein the envelope is uniformly bonded to the linear member using an adhesive comprising an adhesive component and a stabilizing component selected from the group consisting of a wood preservative, an antifungal agent, an antibacterial agent, an insecticide or mixtures thereof.

6. The member of claim 4 wherein each end piece comprises a thermoplastic composite comprising about 40 to about 80 wt % polyvinylchloride and about 20 wt % of wood fiber.

7. The member of claim 1 wherein each end piece comprises a polyvinylchloride composition.

8. The member of claim 1 wherein the envelope comprises a polyvinylchloride composition.

9. The member of claim 8 wherein the envelope additionally comprises an exterior capstock layer.

10. The member of claim 9 wherein the capstock layer comprises a wood grain exterior.

11. The member of claim 1 wherein each end piece comprises a foamed thermoplastic.

12. The structural member of claim 1 wherein the envelope is thermally bonded to each end piece.

13. The member of claim 1 wherein the envelope is bonded to the linear member and each end piece along the entire interface between the envelope, the linear member and each end piece.

14. The member of claim 1 wherein the adhesively bonded envelope is bonded with a thermosetting adhesive.

15. The member of claim 14 wherein the thermosetting adhesive comprises a moisture cure urethane adhesive.

16. The member of claim 1 wherein at least one end piece is adhesively joined to the linear member.

17. The member of claim 1 wherein each end piece is joined to the linear member using a finger joint.

18. The structural member of claim 1 wherein the end pieces are mitered at an angle appropriate to forming a 90° joint with a second structural member.

19. A structural member adapted for the manufacture of a window, said structural member comprising:

(a) a wooden linear member having a first shaped end and a second shaped end;

(b) an end piece, having a shaped end, joined to each of the first shaped end and the second shaped end of the linear wooden member forming a joint between the end piece shaped end and the linear member shaped end, each end piece having a length greater than about 5 cm, each end piece comprising a thermoplastic composite comprising polyvinylchloride and a fiber; and (c) an envelope comprising a polyvinylchloride covering the formerly joined linear member and each end piece, the envelope uniformly adhesively bonded to each end piece and uniformly adhesively bonded to the wooden linear member throughout the interface between each end piece and the linear member with the envelope using a thermosetting adhesive composition.

20. The member of claim 19 wherein the composite comprises about 40 to about 80 wt % polyvinylchloride and about 60 to about 20 wt % of wood fiber.

21. The member of claim 19 wherein the envelope additionally comprises an exterior capstock layer.

22. The member of claim 19 wherein the envelope is uniformly bonded to the linear member using an adhesive comprising an adhesive component and a stabilizing component selected from the group consisting of a wood preservative, an antifungal agent, an antibacterial agent, an insecticide or mixtures thereof.

23. The member of claim 19 wherein the capstock layer comprises a wood grain exterior.

24. The member of claim 19 wherein each end piece comprises a foamed thermoplastic.

25. The member of claim 19 wherein the shaped joint comprises a finger joint.

26. A method for making a structural member adapted for window construction, the method comprising:

(a) forming a linear member comprising wood having a first shaped end and a second shaped end;

(b) forming an end piece having at least one end piece shaped end matching at least one shaped end of the linear member, each end piece having a length greater than about 5 cm, each end piece comprising a thermoplastic composition comprising a resin;

(c) forming a composite member comprising the linear member and one end piece adjoined to each of the first shaped end and the second shaped end of the linear member; and (d) forming, with extrusion, an envelope surrounding the formerly joined composite member wherein the envelope is uniformly adhesively bonded to the composite member.

27. The method of claim 26 wherein the envelope is adhesively bonded to the composite member using a thermosetting adhesive.

28. The method of claim 27 wherein the thermosetting adhesive comprises a moisture cure urethane adhesive.

29. The method of claim 26 further comprising mitering each end piece after the envelope is adhesively bonded to the composite member.

30. The method of claim 29 wherein the end pieces are mitered at an angle appropriate to form a 90° joint with a second composite member.

31. The method of claim 26 wherein the envelope comprises a polyvinylchloride composition.

32. The method of claim 26 wherein the envelope additionally comprises an exterior capstock layer.

33. The method of claim 30 wherein the capstock comprises a wood grain appearance.

34. The method of claim 32 wherein the capstock comprises a polyvinylidene fluoride composition.

35. The method of claim 26 wherein the composite member can vary in length or width in an amount of up to about ±0.020 inch, adhesive is added to the composite member such that the composite member after adhesive addition does not vary more than ±0.005 inch in length or width.

* * * * *

UNITED STATES PATENT AND TRADEMARK OFFICE

CERTIFICATE OF CORRECTION

PATENT NO. : 6,357,197 B1
DATED : March 19, 2002
INVENTOR(S) : Serino et al.

It is certified that error appears in the above-identified patent and that said Letters Patent is hereby corrected as shown below:

Column 19,
Line 55, "85°C + 30°C" should read -- 85°C ± 3°C --
Line 57, "85°C + 30°C" should read -- 85°C ± 3°C --

Column 26,
Line 48, "and about 20 wt%" should read -- and about 60 to about 20 wt% --

Signed and Sealed this

Tenth Day of September, 2002

*Attest:*

*Attesting Officer*

JAMES E. ROGAN
*Director of the United States Patent and Trademark Office*